US009541314B2

(12) United States Patent
Numata et al.

(10) Patent No.: US 9,541,314 B2
(45) Date of Patent: Jan. 10, 2017

(54) HEAT EXCHANGER

(75) Inventors: Mitsuharu Numata, Plymouth, MN (US); Kazushige Kasai, Minnetonka, MN (US)

(73) Assignee: DAIKIN APPLIED AMERICAS INC., Minneapolis, MN (US)

( * ) Notice: Subject to any disclaimer, the term of this patent is extended or adjusted under 35 U.S.C. 154(b) by 992 days.

(21) Appl. No.: 13/453,427

(22) Filed: Apr. 23, 2012

(65) Prior Publication Data

US 2013/0277019 A1 Oct. 24, 2013

(51) Int. Cl.

| | |
|---|---|
| ***F28F 13/06*** | (2006.01) |
| ***F25B 39/02*** | (2006.01) |
| ***F28D 3/02*** | (2006.01) |
| ***F28D 7/16*** | (2006.01) |
| ***F28F 1/00*** | (2006.01) |
| *F28D 3/04* | (2006.01) |

(52) U.S. Cl.

CPC ..... *F25B 39/02* (2013.01); *F28D 3/02* (2013.01); *F28D 7/1607* (2013.01); *F28F 1/006* (2013.01); *F25B 39/028* (2013.01); *F25B 2339/0242* (2013.01); *F28D 3/04* (2013.01)

(58) Field of Classification Search

CPC ... F25B 39/028; F25B 2339/0242; F28D 3/04; F28D 3/02

USPC ..... 165/146, 159, 111, 112, 114, 117; 159/13.3; 62/515, 304

See application file for complete search history.

(56) References Cited

U.S. PATENT DOCUMENTS

| | | | | |
|---|---|---|---|---|
| 2,232,935 A * | 2/1941 | Bailey | | 165/146 |
| 2,384,413 A * | 9/1945 | Zwickl | | 165/159 |
| 2,735,744 A * | 2/1956 | Rex | | 165/146 |
| 3,073,575 A * | 1/1963 | Schulenberg | | 165/146 |
| 3,276,217 A * | 10/1966 | Bourne et al. | | 62/101 |
| 4,339,413 A * | 7/1982 | Lahne | B01J 8/0242 | 165/145 |
| 5,205,352 A * | 4/1993 | Takahashi et al. | | 165/146 |
| 5,588,596 A | 12/1996 | Hartfield et al. | | |
| 6,293,112 B1 | 9/2001 | Moeykens et al. | | |

(Continued)

FOREIGN PATENT DOCUMENTS

| | | |
|---|---|---|
| CN | 1185203 A | 6/1998 |
| CN | 1352373 A | 6/2002 |

(Continued)

OTHER PUBLICATIONS

Office Action for the corresponding Chinese application No. 201380021253.0, issued on Jan. 25, 2016.

*Primary Examiner* — Leonard R Leo
(74) *Attorney, Agent, or Firm* — Global IP Counselors, LLP

(57) ABSTRACT

A heat exchanger is adapted to be used in a vapor compression system, and includes a shell, a distributing part and a tube bundle. The tube bundle includes a plurality of heat transfer tubes arranged in a plurality of columns extending parallel to each other when viewed along the longitudinal center axis of the shell. The heat transfer tubes has at least one of: an arrangement in which a vertical pitch between adjacent ones of the heat transfer tubes in at least one of the columns is larger in an upper region of the tube bundle than in a lower region of the tube bundle; and an arrangement in which a horizontal pitch between adjacent ones of the columns is larger in an outer region of the tube bundle than in an inner region of the tube bundle.

11 Claims, 27 Drawing Sheets

(56) References Cited

U.S. PATENT DOCUMENTS

| | | | | |
|---|---|---|---|---|
| 6,868,695 | B1 | 3/2005 | Dingel et al. | |
| 7,849,710 | B2 | 12/2010 | De Larminat et al. | |
| 2002/0046572 | A1 | 4/2002 | Iritani et al. | |
| 2002/0162352 | A1* | 11/2002 | Ring et al. | 62/515 |
| 2008/0148767 | A1 | 6/2008 | De Larminat et al. | |
| 2008/0149311 | A1 | 6/2008 | Liu et al. | |
| 2010/0242533 | A1 | 9/2010 | De Larminat et al. | |
| 2010/0276130 | A1 | 11/2010 | De Larminat et al. | |
| 2011/0017432 | A1 | 1/2011 | Kulankara et al. | |
| 2011/0120181 | A1 | 5/2011 | De Larminat et al. | |

FOREIGN PATENT DOCUMENTS

| | | | | |
|---|---|---|---|---|
| JP | 44-7224 | A | | 3/1969 |
| JP | 61125588 | A | * | 6/1986 |
| JP | 44-351697 | A | | 12/1999 |
| JP | 2003-65631 | A | | 3/2003 |
| JP | 2003-517560 | A | | 5/2003 |
| JP | 2007-198701 | A | | 8/2007 |
| JP | 2011-80756 | A | | 4/2011 |

* cited by examiner

HEAT EXCHANGER

BACKGROUND OF THE INVENTION

Field of the Invention

This invention generally relates to a heat exchanger adapted to be used in a vapor compression system. More specifically, this invention relates to a heat exchanger having a prescribed arrangement of a tube bundle for preventing a vapor flow velocity from exceeding a prescribed level.

Background Information

Vapor compression refrigeration has been the most commonly used method for air-conditioning of large buildings or the like. Conventional vapor compression refrigeration systems are typically provided with an evaporator, which is a heat exchanger that allows the refrigerant to evaporate from liquid to gas while absorbing heat from liquid to be cooled passing through the evaporator. One type of evaporator includes a tube bundle having a plurality of horizontally extending heat transfer tubes through which the liquid to be cooled is circulated, and the tube bundle is housed inside a cylindrical shell. There are several known methods for evaporating the refrigerant in this type of evaporator. In a flooded evaporator, the shell is filled with liquid refrigerant and the heat transfer tubes are immersed in a pool of the liquid refrigerant so that the liquid refrigerant boils and/or evaporates as vapor. In a falling film evaporator, liquid refrigerant is deposited onto exterior surfaces of the heat transfer tubes from above so that a layer or a thin film of the liquid refrigerant is formed along the exterior surfaces of the heat transfer tubes. Heat from walls of the heat transfer tubes is transferred via convection and/or conduction through the liquid film to the vapor-liquid interface where part of the liquid refrigerant evaporates, and thus, heat is removed from the water flowing inside of the heat transfer tubes. The liquid refrigerant that does not evaporate falls vertically from the heat transfer tube at an upper position toward the heat transfer tube at a lower position by force of gravity. There is also a hybrid falling film evaporator, in which the liquid refrigerant is deposited on the exterior surfaces of some of the heat transfer tubes in the tube bundle and the other heat transfer tubes in the tube bundle are immersed in the liquid refrigerant that has been collected at the bottom portion of the shell.

Although the flooded evaporators exhibit high heat transfer performance, the flooded evaporators require a considerable amount of refrigerant because the heat transfer tubes are immersed in a pool of the liquid refrigerant. With recent development of new and high-cost refrigerant having a much lower global warming potential (such as R1234ze or R1234yf), it is desirable to reduce the refrigerant charge in the evaporator. The main advantage of the falling film evaporators is that the refrigerant charge can be reduced while ensuring good heat transfer performance. Therefore, the falling film evaporators have a significant potential to replace the flooded evaporators in large refrigeration systems. However, there are several technical challenges associated with the efficient operation of the falling film evaporator.

One of the challenges is managing vapor flow within the tube bundle of a falling film evaporator. In general, a portion of the liquid refrigerant that vaporized significantly expands in volume in all directions, causing cross flow or travel by the vaporized refrigerant in a transverse direction. This cross flow disrupts the vertical flow of the liquid refrigerant, which increases a risk of the lower tubes receiving insufficient wetting, causing significantly reduced heat transfer performance. Another challenge is preventing entrained liquid droplets from being carried over from the evaporator to the compressor. The compressor can be damaged if the vaporized refrigerant contains entrained liquid droplets.

U.S. Pat. No. 6,293,112 discloses a falling film evaporator in which the tubes of the tube bundle are arranged to form vapor lanes extending in a transverse direction to control the velocity of cross flow of the refrigerant vapor created interior of the tube bundle.

U.S. Pat. No. 7,849,710 discloses a falling film evaporator that includes a hood disposed over the tube bundle. The hood forces the flow of vapor refrigerant to move downward, thereby preventing cross flow of the vapor refrigerant inside the hood. Also, the abrupt directional change of the vapor refrigerant flow caused by the hood results in removal of a great proportion of entrained liquid droplets from the vapor refrigerant flow.

SUMMARY OF THE INVENTION

The vapor lanes formed in the tube bundle of the falling film evaporator disclosed in U.S. Pat. No. 5,839,294 are relatively wide, and thus, a distance between the tubes above and below the vapor lane is large. Therefore, the liquid refrigerant may not be properly delivered by droplets from the tubes in a region above the vapor lane to the tubes in a region below the vapor lane, causing the tubes in the lower region left unwetted. On the other hand, the vapor flow created by the hood covering the tube bundle as disclosed in U.S. Pat. No. 7,849,710 causes a pressure loss in the evaporator such that evaporation temperature will be decreased, thereby degrading heat transfer performance.

In view of the above, one object of the present invention is to provide a heat exchanger having a prescribed arrangement of a tube bundle so that a vapor velocity does not exceed a prescribed velocity at any location within the tube bundle.

A heat exchanger according to one aspect of the present invention is adapted to be used in a vapor compression system, and includes a shell, a distributing part and a tube bundle. The shell has a longitudinal center axis extending generally parallel to a horizontal plane. The distributing part is disposed inside of the shell, and configured and arranged to distribute a refrigerant. The tube bundle includes a plurality of heat transfer tubes disposed inside of the shell below the distributing part so that the refrigerant discharged from the distributing part is supplied onto the tube bundle. The heat transfer tubes extend generally parallel to the longitudinal center axis of the shell and are arranged in a plurality of columns extending parallel to each other when viewed along the longitudinal center axis of the shell. The tube bundle has least one of an arrangement in which a vertical pitch between adjacent ones of the heat transfer tubes in at least one of the columns is larger in an upper region of the tube bundle than in a lower region of the tube bundle, and an arrangement in which a horizontal pitch between adjacent ones of the columns is larger in an outer region of the tube bundle than in an inner region of the tube bundle.

A heat exchanger according to another aspect is adapted to be used in a vapor compression system, and includes a shell, a distributing part, and a tube bundle. The shell has a longitudinal center axis extending generally parallel to a horizontal plane. The distributing part is disposed inside of the shell, and configured and arranged to distribute a refrigerant. The tube bundle includes a plurality of heat transfer tubes disposed inside of the shell below the distributing part so that the refrigerant discharged from the distributing part is supplied onto the tube bundle. The heat transfer tubes extend generally parallel to the longitudinal center axis of the shell and are arranged in a plurality of columns extending parallel to each other when viewed along the longitudinal center axis of the shell. At least one of a vertical pitch between adjacent ones of the heat transfer tubes in each of the columns of the heat transfer tubes and a horizontal pitch between adjacent ones of the columns of the heat transfer tubes being varied so that a flow velocity of a refrigerant vapor flowing between the heat transfer tubes does not exceed a prescribed flow velocity.

These and other objects, features, aspects and advantages of the present invention will become apparent to those skilled in the art from the following detailed description, which, taken in conjunction with the annexed drawings, discloses preferred embodiments.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

Figure 1:
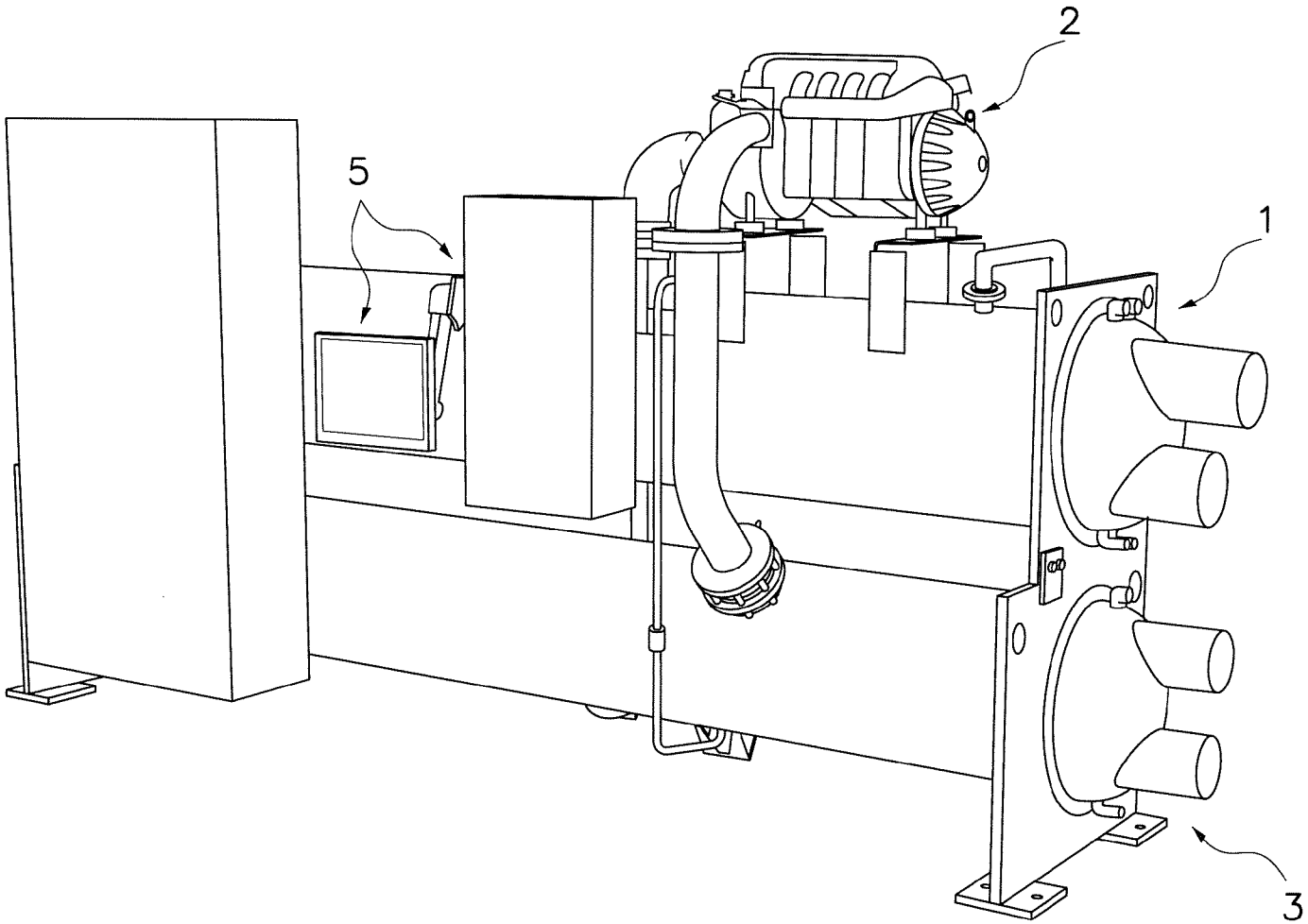
FIG. 1 is a simplified overall perspective view of a vapor compression system including a heat exchanger according to a first embodiment of the present invention.
Figure 2:
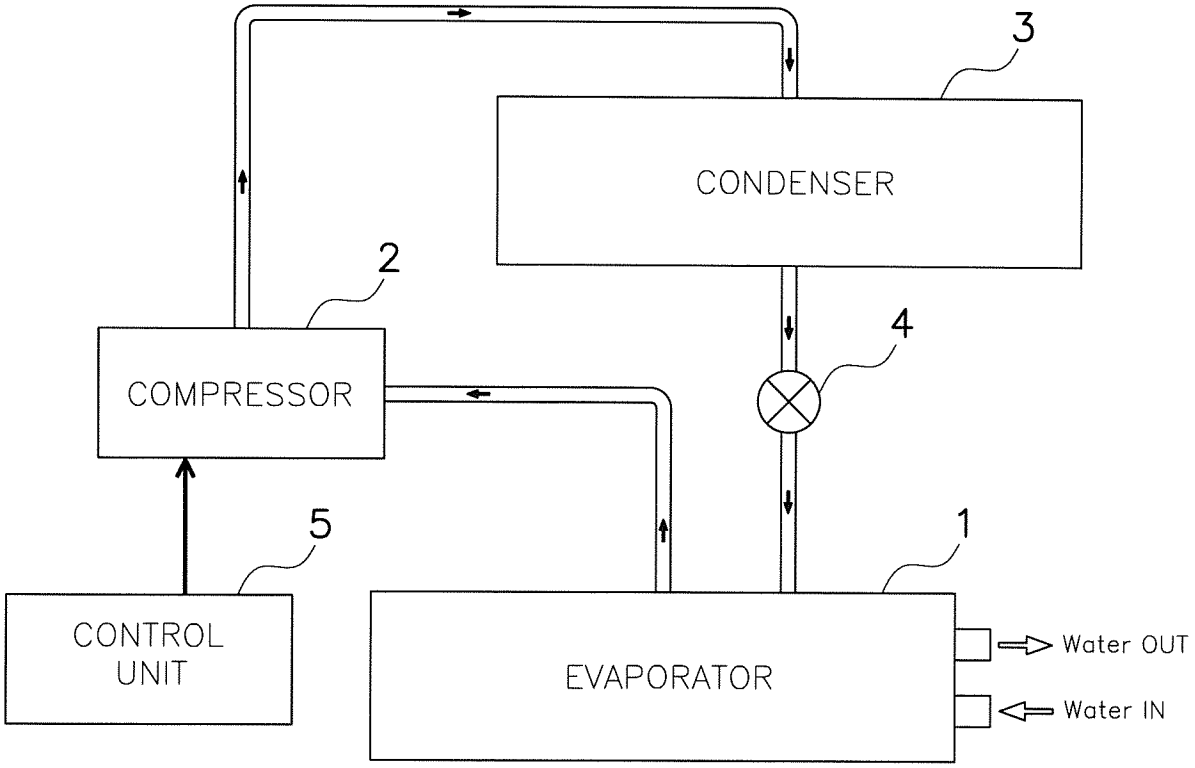
FIG. 2 is a block diagram illustrating a refrigeration circuit of the vapor compression system including the heat exchanger according to the first embodiment of the present invention.

Referring initially to FIGS. 1 and 2, a vapor compression system including a heat exchanger according to a first embodiment will be explained. As seen in FIG. 1, the vapor compression system according to the first embodiment is a chiller that may be used in a heating, ventilation and air conditioning (HVAC) system for air-conditioning of large buildings and the like. The vapor compression system of the first embodiment is configured and arranged to remove heat from liquid to be cooled (e.g., water, ethylene, ethylene glycol, calcium chloride brine, etc.) via a vapor-compression refrigeration cycle.

As shown in FIGS. 1 and 2, the vapor compression system includes the following four main components: an evaporator 1, a compressor 2, a condenser 3 and an expansion device 4.

The evaporator 1 is a heat exchanger that removes heat from the liquid to be cooled (in this example, water) passing through the evaporator 1 to lower the temperature of the water as a circulating refrigerant evaporates in the evaporator 1. The refrigerant entering the evaporator 1 is in a two-phase gas/liquid state. The liquid refrigerant evaporates as the vapor refrigerant in the evaporator 1 while absorbing heat from the water.

The low pressure, low temperature vapor refrigerant is discharged from the evaporator 1 and enters the compressor 2 by suction. In the compressor 2, the vapor refrigerant is compressed to the higher pressure, higher temperature vapor. The compressor 2 may be any type of conventional compressor, for example, centrifugal compressor, scroll compressor, reciprocating compressor, screw compressor, etc.

Next, the high temperature, high pressure vapor refrigerant enters the condenser 3, which is another heat exchanger that removes heat from the vapor refrigerant causing it to condense from a gas state to a liquid state. The condenser 3 may be an air-cooled type, a water-cooled type, or any suitable type of condenser. The heat raises the temperature of cooling water or air passing through the condenser 3, and the heat is rejected to outside of the system as being carried by the cooling water or air.

The condensed liquid refrigerant then enters through the expansion device 4 where the refrigerant undergoes an abrupt reduction in pressure. The expansion device 4 may be as simple as an orifice plate or as complicated as an electronic modulating thermal expansion valve. The abrupt pressure reduction results in partial evaporation of the liquid refrigerant, and thus, the refrigerant entering the evaporator 1 is in a two-phase gas/liquid state.

Some examples of refrigerants used in the vapor compression system are hydrofluorocarbon (HFC) based refrigerants, for example, R-410A, R-407C, and R-134a, hydrofluoro olefin (HFO), unsaturated HFC based refrigerant, for example, R-1234ze, and R-1234yf, natural refrigerants, for example, R-717 and R-718, or any other suitable type of refrigerant.

The vapor compression system includes a control unit 5 that is operatively coupled to a drive mechanism of the compressor 2 to control operation of the vapor compression system.

It will be apparent to those skilled in the art from this disclosure that conventional compressor, condenser and expansion device may be used respectively as the compressor 2, the condenser 3 and the expansion device 4 in order to carry out the present invention. In other words, the compressor 2, the condenser 3 and the expansion device 4 are conventional components that are well known in the art. Since the compressor 2, the condenser 3 and the expansion device 4 are well known in the art, these structures will not be discussed or illustrated in detail herein. The vapor compression system may include a plurality of evaporators 1, compressors 2 and/or condensers 3.

Figure 3:
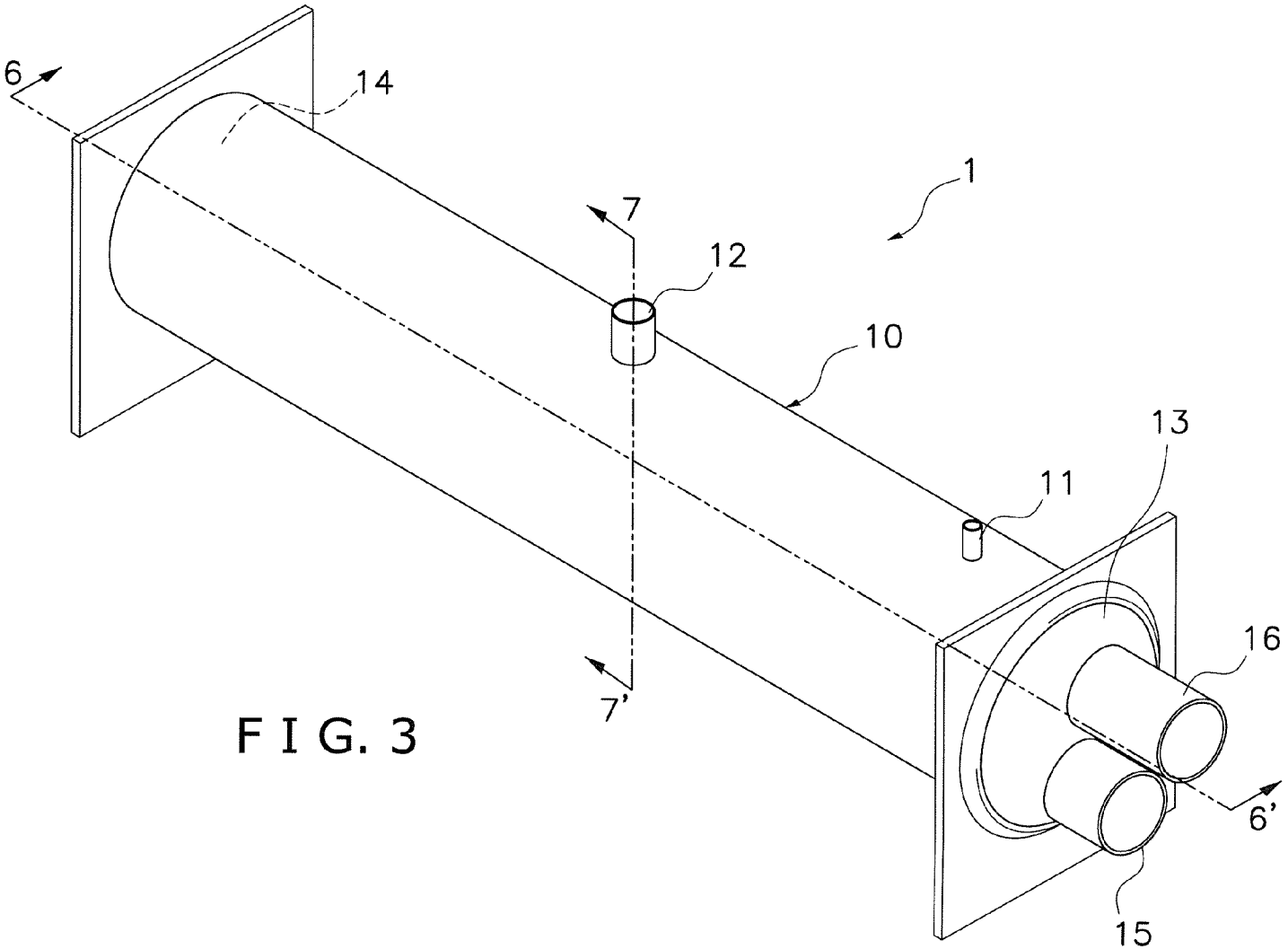
FIG. 3 is a simplified perspective view of the heat exchanger according to the first embodiment of the present invention.
Figure 4:
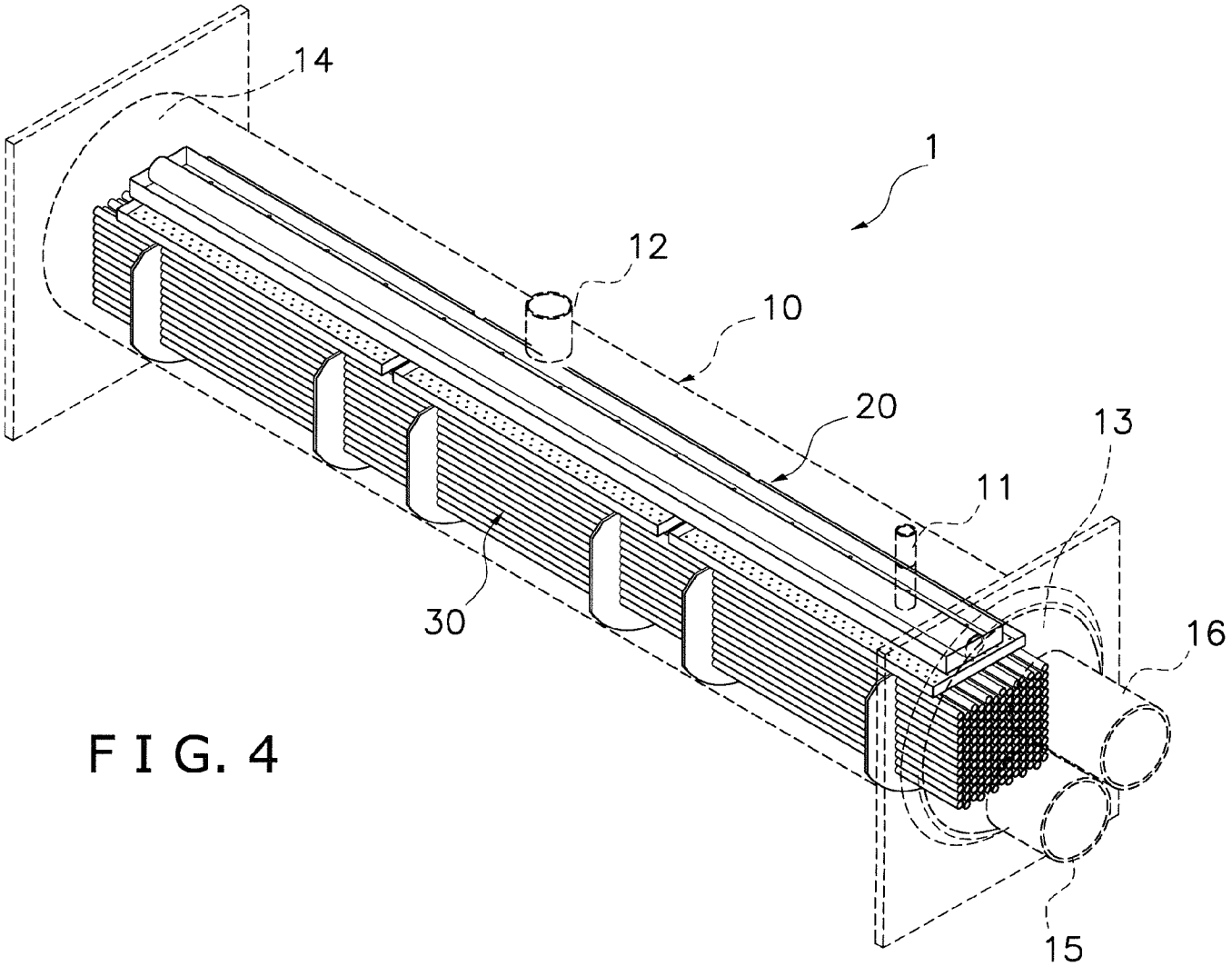
FIG. 4 is a simplified perspective view of an internal structure of the heat exchanger according to the first embodiment of the present invention.
Figure 5:
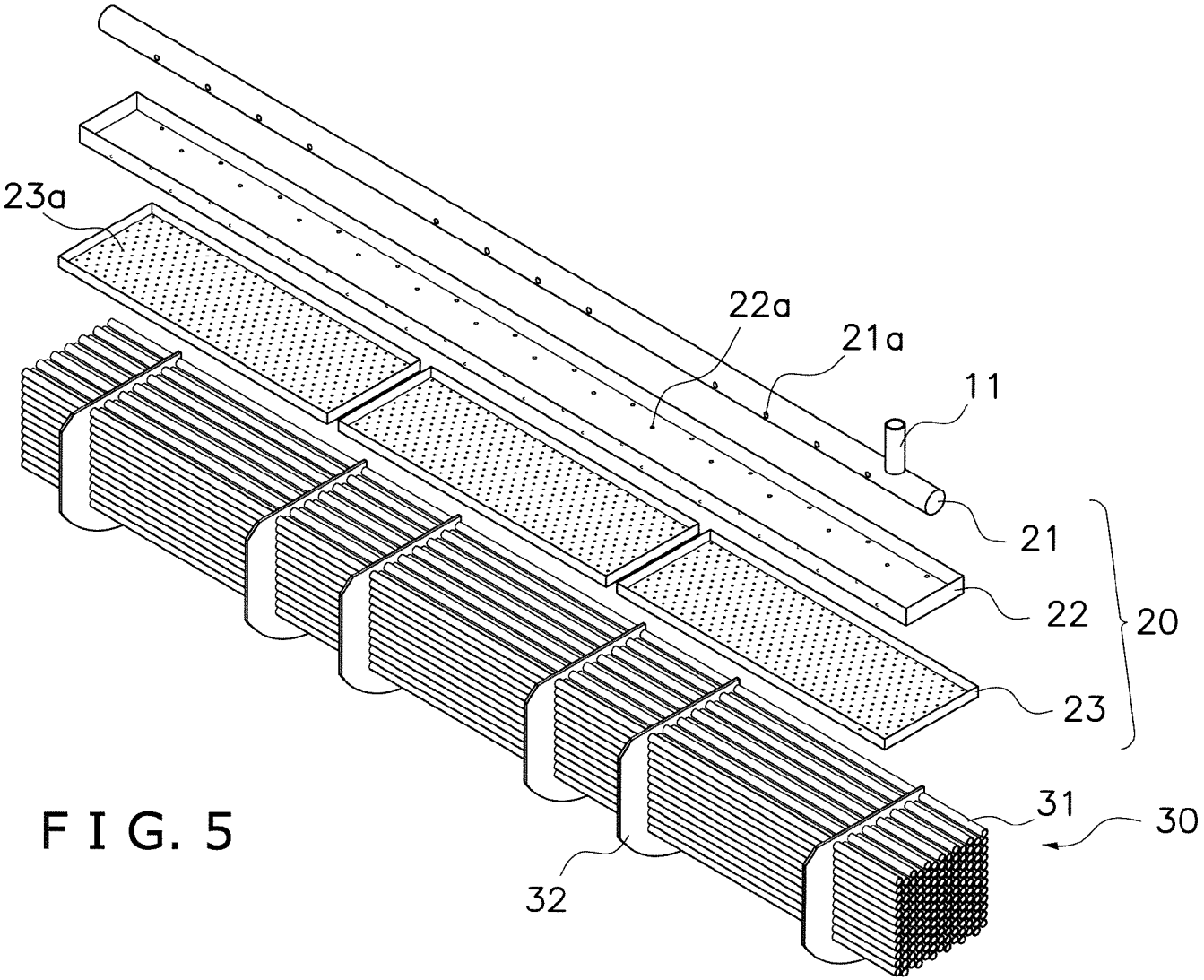
FIG. 5 is an exploded view of the internal structure of the heat exchanger according to the first embodiment of the present invention.
Figure 6:
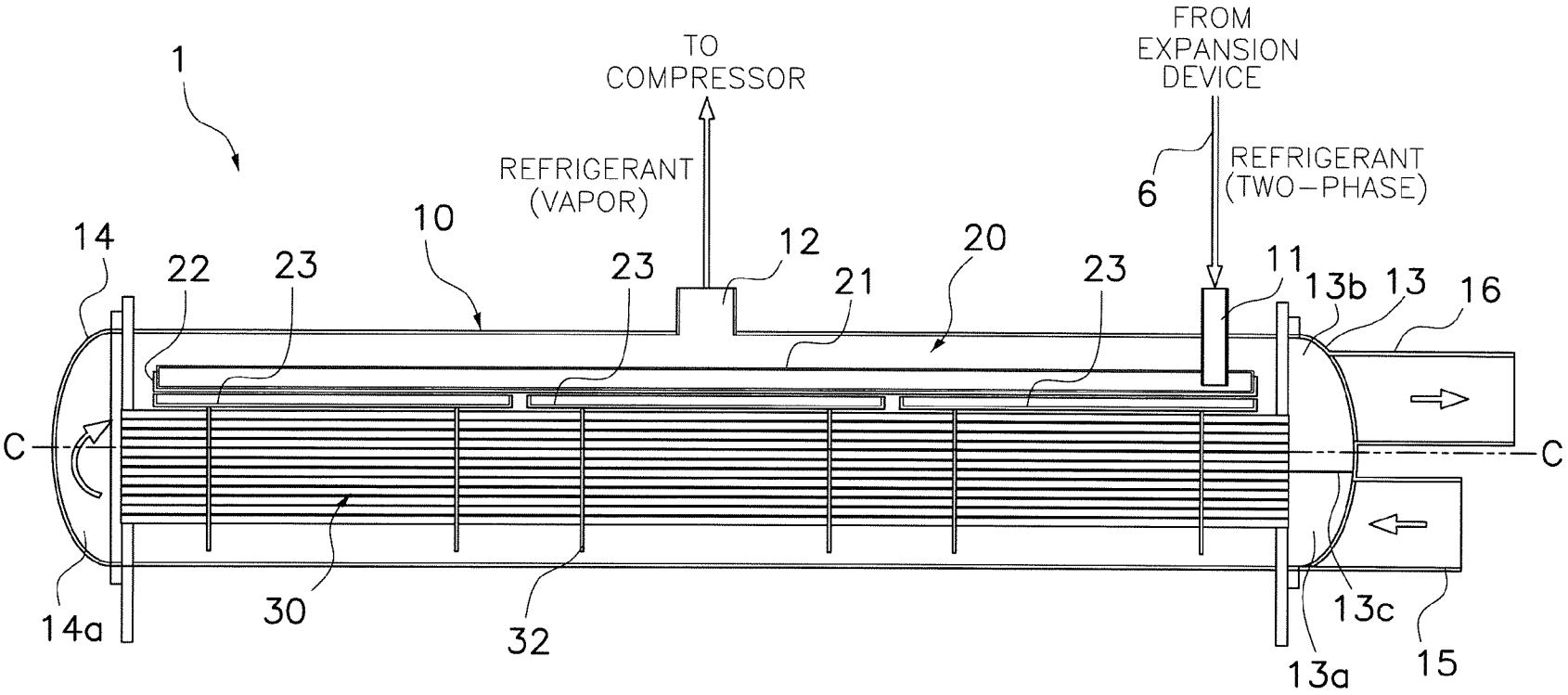
FIG. 6 is a simplified longitudinal cross sectional view of the heat exchanger according to the first embodiment of the present invention as taken along a section line 6-6' in FIG. 3.

Referring now to FIGS. 3 to 5, the detailed structure of the evaporator 1, which is the heat exchanger according to the first embodiment, will be explained. As shown in FIGS. 3 and 6, the evaporator 1 includes a shell 10 having a generally cylindrical shape with a longitudinal center axis C (FIG. 6) extending generally in the horizontal direction. The shell 10 includes a connection head member 13 defining an inlet water chamber 13*a* and an outlet water chamber 13*b*, and a return head member 14 defining a water chamber 14*a*. The connection head member 13 and the return head member 14 are fixedly coupled to longitudinal ends of a cylindrical body of the shell 10. The inlet water chamber 13*a* and the outlet water chamber 13*b* are partitioned by a water baffle 13*c*. The connection head member 13 includes a water inlet pipe 15 through which water enters the shell 10 and a water outlet pipe 16 through which the water is discharged from the shell 10. As shown in FIGS. 3 and 6, the shell 10 further includes a refrigerant inlet pipe 11 and a refrigerant outlet pipe 12. The refrigerant inlet pipe 11 is fluidly connected to the expansion device 4 via a supply conduit 6 (FIG. 7) to introduce the two-phase refrigerant into the shell 10. The expansion device 4 may be directly coupled at the refrigerant inlet pipe 11. The liquid component in the two-phase refrigerant boils and/or evaporates in the evaporator 1 and goes through phase change from liquid to vapor as it absorbs heat from the water passing through the evaporator 1. The vapor refrigerant is drawn from the refrigerant outlet pipe 12 to the compressor 2 by suction.

Figure 7:
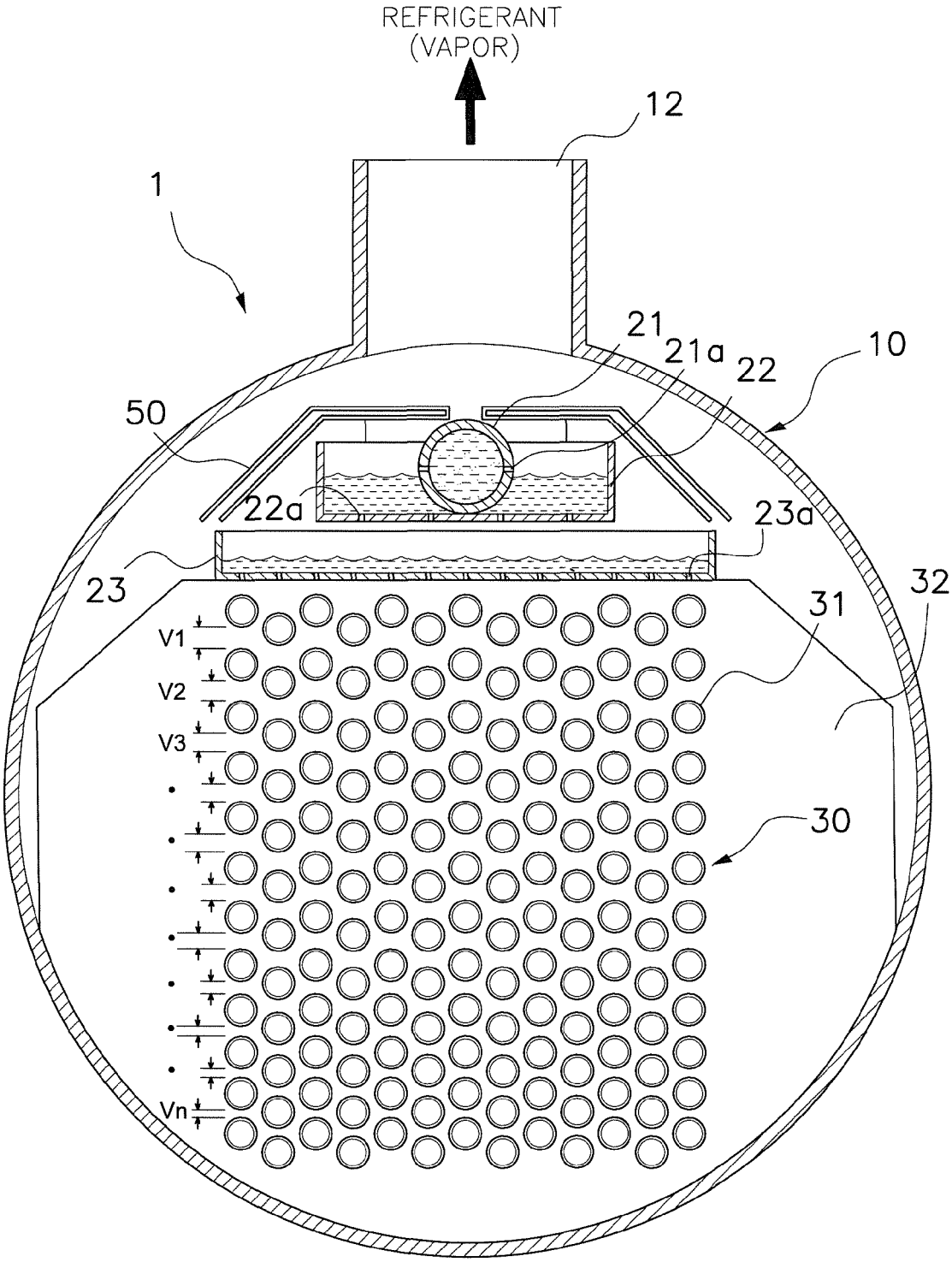
FIG. 7 is a simplified transverse cross sectional view of the heat exchanger according to the first embodiment of the present invention as taken along a section line 7-7' in FIG. 3.

FIG. 4 is a simplified perspective view illustrating an internal structure accommodated in the shell 10. FIG. 5 is an exploded view of the internal structure shown in FIG. 4. As shown in FIGS. 4 and 5, the evaporator 1 basically includes a distributing part 20, a tube bundle 30, and a trough part 40. The evaporator 1 preferably further includes a baffle member 50 as shown in FIG. 7 although illustration of the baffle member 50 is omitted in FIGS. 4-6 for the sake of brevity.

The distributing part 20 is configured and arranged to serve as both a gas-liquid separator and a refrigerant distributor. As shown in FIG. 5, the distributing part 20 includes an inlet pipe part 21, a first tray part 22 and a plurality of second tray parts 23.

As shown in FIG. 6, the inlet pipe part 21 extends generally parallel to the longitudinal center axis C of the shell 10. The inlet pipe part 21 is fluidly connected to the refrigerant inlet pipe 11 of the shell 10 so that the two-phase refrigerant is introduced into the inlet pipe part 21 via the refrigerant inlet pipe 11. The inlet pipe part 21 includes a plurality of openings 21*a* disposed along the longitudinal length of the inlet pipe part 21 for discharging the two-phase refrigerant. When the two-phase refrigerant is discharged from the openings 21*a* of the inlet pipe part 21, the liquid component of the two-phase refrigerant discharged from the openings 21*a* of the inlet pipe part 21 is received by the first tray part 22. On the other hand, the vapor component of the two-phase refrigerant flows upwardly and impinges the baffle member 50 shown in FIG. 7, so that liquid droplets entrained in the vapor are captured by the baffle member 50. The liquid droplets captured by the baffle member 50 are guided along a slanted surface of the baffle member 50 toward the first tray part 22. The baffle member 50 may be configured as a plate member, a mesh screen, or the like. The vapor component flows downwardly along the baffle member 50 and then changes its direction upwardly toward the outlet pipe 12. The vapor refrigerant is discharged toward the compressor 2 via the outlet pipe 12.

As shown in FIGS. 5 and 6, the first tray part 22 extends generally parallel to the longitudinal center axis C of the shell 10. As shown in FIG. 7, a bottom surface of the first tray part 22 is disposed below the inlet pipe part 21 to receive the liquid refrigerant discharged from the openings 21*a* of the inlet pipe part 21. In the first embodiment, the inlet pipe part 21 is disposed within the first tray part 22 so that no vertical gap is formed between the bottom surface of the first tray part 22 and the inlet pipe part 21 as shown in FIG. 7. In other words, in the first embodiment, a majority of the inlet pipe part 21 overlaps the first tray part 22 when viewed along a horizontal direction perpendicular to the longitudinal center axis C of the shell 10 as shown in FIG. 6. This arrangement is advantageous because an overall volume of the liquid refrigerant accumulated in the first tray part 22 can be reduced while maintaining a level (height) of the liquid refrigerant accumulated in the first tray part 22 relatively high. Alternatively, the inlet pipe part 21 and the first tray part 22 may be arranged such that a larger vertical gap is formed between the bottom surface of the first tray part 22 and the inlet pipe part 21. The inlet pipe part 21, the first tray part 22 and the baffle member 50 are preferably coupled together and suspended from above in an upper portion of the shell 10 in a suitable manner.

As shown in FIGS. 5 and 7, the first tray part 22 has a plurality of first discharge apertures 22*a* from which the liquid refrigerant accumulated therein is discharged downwardly. The liquid refrigerant discharged from the first discharge apertures 22*a* of the first tray part 22 is received by one of the second tray parts 23 disposed below the first tray part 22.

As shown in FIGS. 5 and 6, the distributing part 20 of the first embodiment includes three identical second try parts 23. The second tray parts 23 are aligned side-by-side along the longitudinal center axis C of the shell 10. As shown in FIG. 6, an overall longitudinal length of the three second tray parts 23 is substantially the same as a longitudinal length of the first tray part 22 as shown in FIG. 6. A transverse width of the second tray part 23 is set to be larger than a transverse width of the first tray part 22 so that the second tray part 23 extends over substantially an entire width of the tube bundle 30 as shown in FIG. 7. The second tray parts 23 are arranged so that the liquid refrigerant accumulated in the second tray parts 23 does not communicate between the second tray parts 23. As shown in FIGS. 5 and 7, each of the second tray parts 23 has a plurality of second discharge apertures 23*a* from which the liquid refrigerant is discharged downwardly toward the tube bundle 30.

It will be apparent to those skilled in the art from this disclosure that structure and configuration of the distributing part 20 are not limited to the ones described herein. Any conventional structure for distributing the liquid refrigerant downwardly onto the tube bundle 30 may be utilized to carry out the present invention. For example, a conventional distributing system utilizing spray tree tubes and the like may be used as the distributing part 20. In other words, any conventional distributing system that is compatible with a falling film type evaporator can be used as the distributing part 20 to carry out the present invention.

The tube bundle 30 is disposed below the distributing part 20 so that the liquid refrigerant discharged from the distributing part 20 is supplied onto the tube bundle 30. The tube bundle 30 includes a plurality of heat transfer tubes 31 that extend generally parallel to the longitudinal center axis C of the shell 10 as shown in FIG. 6. The heat transfer tubes 31 are made of materials having high thermal conductivity, such as metal, and preferably provided with interior and exterior grooves to further promote heat exchange between the refrigerant and the water flowing inside the heat transfer tubes 31. Such heat transfer tubes including the interior and exterior grooves are well known in the art. For example, Thermoexel-E tubes by Hitachi Cable Ltd. may be used as the heat transfer tubes 31 of this embodiment. As shown in FIG. 5, the heat transfer tubes 31 are supported by a plurality of vertically extending support plates 32, which are fixedly coupled to the shell 10. In the first embodiment, the tube bundle 30 is arranged to form a two-pass system, in which the heat transfer tubes 31 are divided into a supply line group disposed in a lower region of the tube bundle 30, and a return line group disposed in an upper region of the tube bundle 30. As shown in FIG. 6, inlet ends of the heat transfer tubes 31 in the supply line group are fluidly connected to the water inlet pipe 15 via the inlet water chamber 13*a* of the connection head member 13 so that water entering the evaporator 1 is distributed into the heat transfer tubes 31 in the supply line group. Outlet ends of the heat transfer tubes 31 in the supply line group and inlet ends of the heat transfer tubes 31 of the return line tubes are fluidly communicated with a water chamber 14*a* of the return head member 14. Therefore, the water flowing inside the heat transfer tubes 31 in the supply line group is discharged into the water chamber 14*a*, and redistributed into the heat transfer tubes 31 in the return line group. Outlet ends of the heat transfer tubes 31 in the return line group are fluidly communicated with the water outlet pipe 16 via the outlet water chamber 13*b* of the connection head member 13. Thus, the water flowing inside the heat transfer tubes 31 in the return line group exits the evaporator 1 through the water outlet pipe 16. In a typical two-pass evaporator, the temperature of the water entering at the water inlet pipe 15 may be about 54 degrees F. (about 12° C.), and the water is cooled to about 44 degrees F. (about 7° C.) when it exits from the water outlet pipe 16. Although, in this embodiment, the evaporator 1 is arranged to form a two-pass system in which the water goes in and out on the same side of the evaporator 1, it will be apparent to those skilled in the art from this disclosure that the other conventional system such as a one-pass or three-pass system may be used. Moreover, in the two-pass system, the return line group may be disposed below or side-by-side with the supply line group instead of the arrangement illustrated herein.

The detailed tube bundle geometry of the evaporator 1 according to the first embodiment will be explained with reference to FIG. 7. FIG. 7 is a simplified transverse cross sectional view of the evaporator 1 taken along a section line 7-7' in FIG. 3.

As described above, the refrigerant in a two-phase state is supplied through the supply conduit 6 to the inlet pipe part 21 of the distributing part 20 via the inlet pipe 11. In FIG. 7, the flow of refrigerant in the refrigeration circuit is schematically illustrated, and the inlet pipe 11 is omitted for the sake of brevity. The vapor component of the refrigerant supplied to the distributing part 20 is separated from the liquid component in the first tray section 22 of the distributing part 20 and exits the evaporator 1 through the outlet pipe 12. On the other hand, the liquid component of the two-phase refrigerant is accumulated in the first tray part 22 and then in the second tray parts 23, and discharged from the discharge apertures 23*a* of the second tray part 23 downwardly towards the tube bundle 30.

The heat transfer tubes 31 of the tube bundle 30 are configured and arranged to perform falling film evaporation of the liquid refrigerant distributed from the distributing part 20. More specifically, the heat transfer tubes 31 are arranged such that the liquid refrigerant discharged from the distributing part 20 forms a layer (or a film) along an exterior wall of each of the heat transfer tubes 31, where the liquid refrigerant evaporates as vapor refrigerant while it absorbs heat from the water flowing inside the heat transfer tubes 31 As shown in FIG. 7, the heat transfer tubes 31 are arranged in a plurality of vertical columns extending parallel to each other when seen in a direction parallel to the longitudinal center axis C of the shell 10 (as shown in FIG. 7). Therefore, the refrigerant falls downwardly from one heat transfer tube to another by force of gravity in each of the columns of the heat transfer tubes 31. The columns of the heat transfer tubes 31 are disposed with respect to the second discharge openings 23*a* of the second tray part 23 so that the liquid refrigerant discharged from the second discharge openings 23*a* is deposited onto an uppermost one of the heat transfer tubes 31 in each of the columns. In the first embodiment, the columns of the heat transfer tubes 31 are arranged in a staggered pattern as shown in FIG. 7. In the first embodiment, a vertical pitch between two adjacent ones of the heat transfer tubes 31 is substantially constant. Likewise, a horizontal pitch between two adjacent ones of the columns of the heat transfer tubes 31 is substantially constant.

Figure 8:
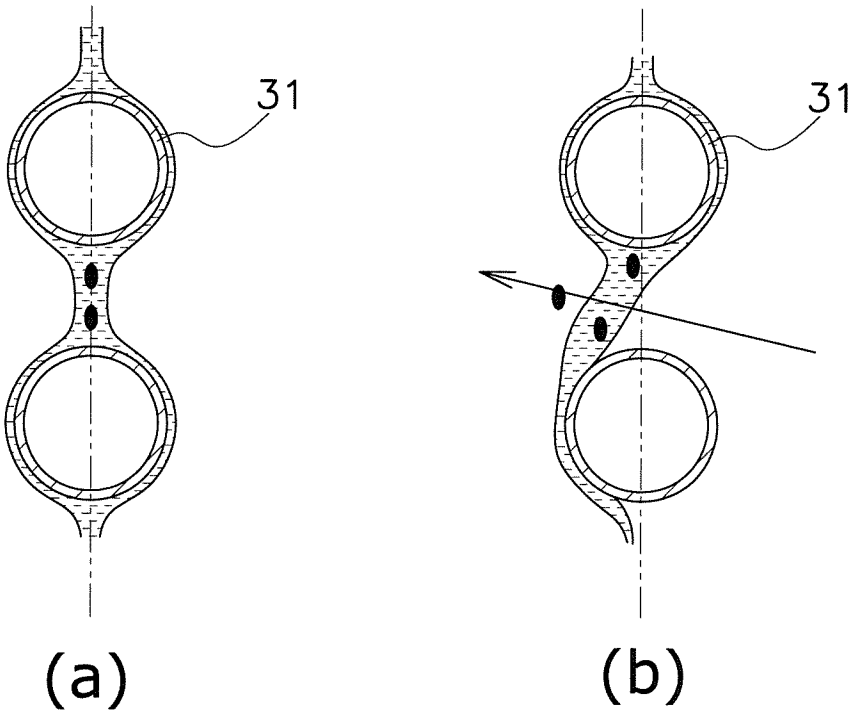
FIG. 8 includes enlarged schematic cross sectional views of heat transfer tubes illustrating an ideal state of the liquid refrigerant falling from one tube to another (diagram (a)), and illustrating a state in which the vertical flow the liquid refrigerant falling from one tube to another is affected by the transverse vapor flow (diagram (b))

A portion of the liquid refrigerant that vaporized significantly expands in volume in all directions, causing cross flow or travel by the vaporized refrigerant in a transverse direction. It has been discovered that the vapor velocity of this cross flow is higher in an upper region and an outer region of a tube bundle when both a vertical pitch and a horizontal pitch between heat transfer tubes of the tube bundle are substantially constant. If such a local vapor velocity within the tube bundle becomes too high, particularly in a transverse direction of the tube bundle, disruption of the film of liquid refrigerant that develops around individual tubes can occur. FIG. 8 includes enlarged schematic cross sectional views of the heat transfer tubes illustrating an ideal state of the liquid refrigerant falling from one tube to another (diagram (a)), and illustrating a state in which the vertical flow the liquid refrigerant falling from one tube to another is affected by the transverse vapor flow (diagram (b)). As shown in the diagram (b), disruption of the liquid refrigerant film can lead to formation of dry patches, which degrades the overall heat transfer performance of the falling film evaporator. Moreover, the high velocity vapor flow in the upper region of the tube bundle causes the liquid droplets be entrained in the vapor as shown in the diagram (b), and the entrained liquid droplets will be carried over to the compressor 2. The influence of such a phenomenon is even larger on a large-scale evaporator.

Accordingly, the tube bundle 30 of the first embodiment has a prescribed arrangement for suppressing formation of the high velocity vapor flow in the tube bundle 30. In the first embodiment, a vertical pitch between adjacent ones of the heat transfer tubes 31 in each of the columns is set to be larger in an upper region of the tube bundle 30 than in a lower region of the tube bundle 30.

More specifically, as shown in FIG. 7, the vertical pitch (V1, V2, V3, . . . , Vn) gradually increases from a minimum vertical pitch Vn between the lowermost and the second lowermost ones of the heat transfer tubes 31 to a maximum vertical pitch V1 between the second uppermost and the uppermost ones of the heat transfer tubes 31. The maximum vertical pitch V1 is set to be a distance that ensures reliable dripping of the liquid refrigerant from the uppermost one of the heat transfer tubes 31 to the second uppermost one of the heat transfer tubes 31. For example, when a minimum vertical pitch Vn is about 3.5 mm, a maximum vertical pitch V1 is preferably about 8 mm.

By enlarging the vertical pitch in an upper region of the tube bundle 30, the cross sectional area of passages through which the cross flow passes can be increased. Therefore, increase in the vapor velocity in the upper region of the tube bundle 30 can be suppressed with a simple structure. Accordingly, with the arrangement of the tube bundle 30 according to the first embodiment, the vapor velocity in the tube bundle 30 does not exceed a prescribed maximum velocity (e.g., about 0.7 m/s to 1.0 m/s) at any location of the tube bundle 30. Thus, disruption of vertical flow of the liquid refrigerant by high velocity cross flow can be eliminated, thereby preventing formation of dry patches in the heat transfer tubes 31. Moreover, since the velocity of the vapor flow can be suppressed according to the first embodiment, occurrence of the entrained liquid droplets can also be reduced.

The arrangement of the tube bundle 30 is not limited to the ones illustrated in FIG. 7. It will be apparent to those skilled in the art from this disclosure that various changes and modifications can be made herein without departing from the scope of the invention. Several modified examples will be explained with reference to FIGS. 9 to 13.

Figure 9:
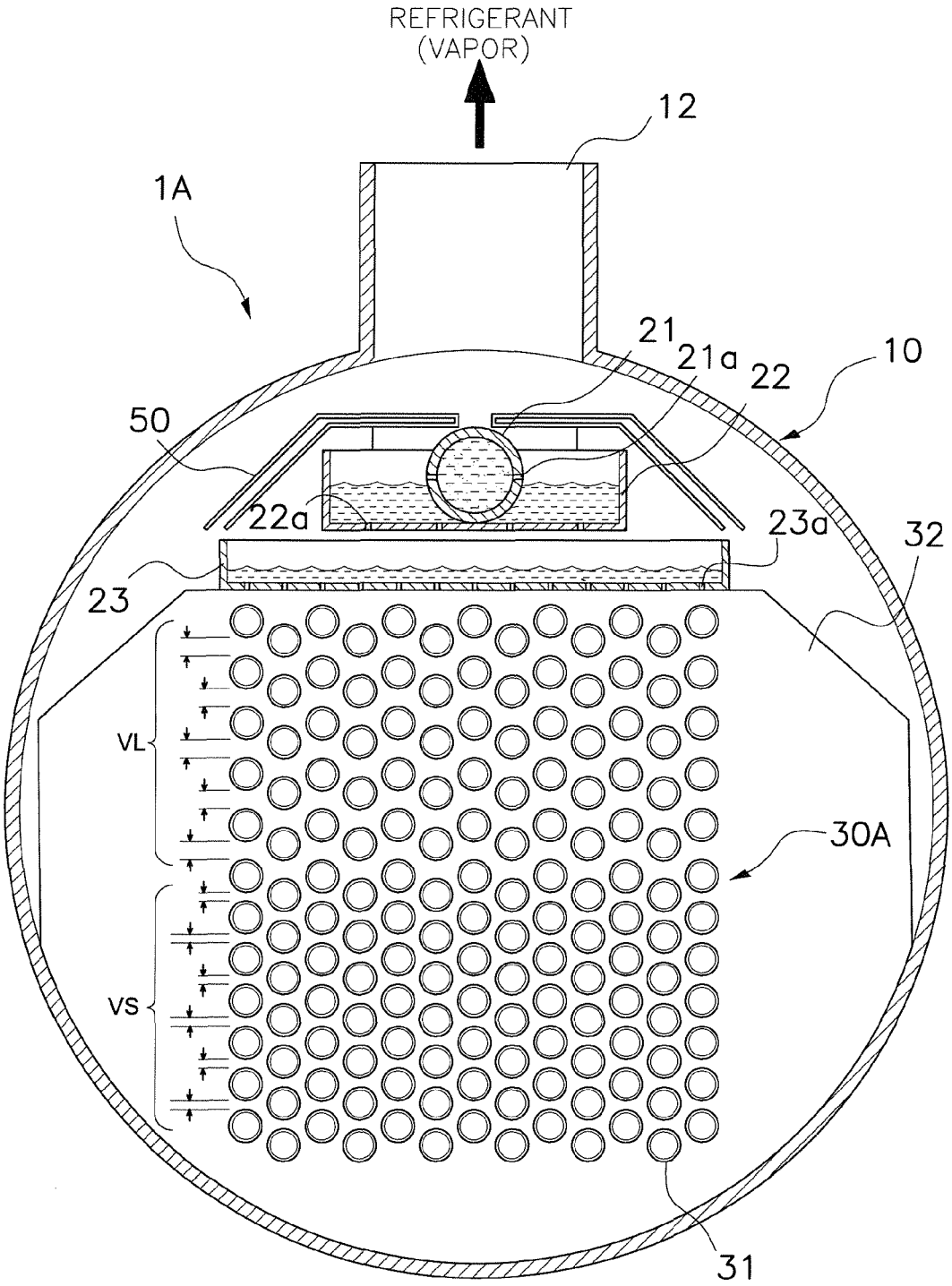
FIG. 9 is a simplified transverse cross sectional view of the heat exchanger illustrating a first modified example for an arrangement of a tube bundle according to the first embodiment of the present invention.

FIG. 9 is a simplified transverse cross sectional view of an evaporator 1A illustrating a first modified example for an arrangement of a tube bundle 30A according to the first embodiment. The evaporator 1A is basically the same as the evaporator 1 illustrated in FIGS. 2 to 7 except for the geometry of the tube bundle 30A. More specifically, in this modified example, the heat transfer tubes 31 are arranged such that a vertical pitch between adjacent ones of the heat transfer tubes 31 in each of the columns in the lower region of the tube bundle 30A is a first vertical pitch VS, and a vertical pitch between adjacent ones of the heat transfer tubes 31 in each of the columns in the upper region of the tube bundle 30A is a second vertical pitch VL that is larger than the first vertical pitch VS. With this modified example, the similar effects as discussed above can be obtained with an even simpler structure.

Figure 10:
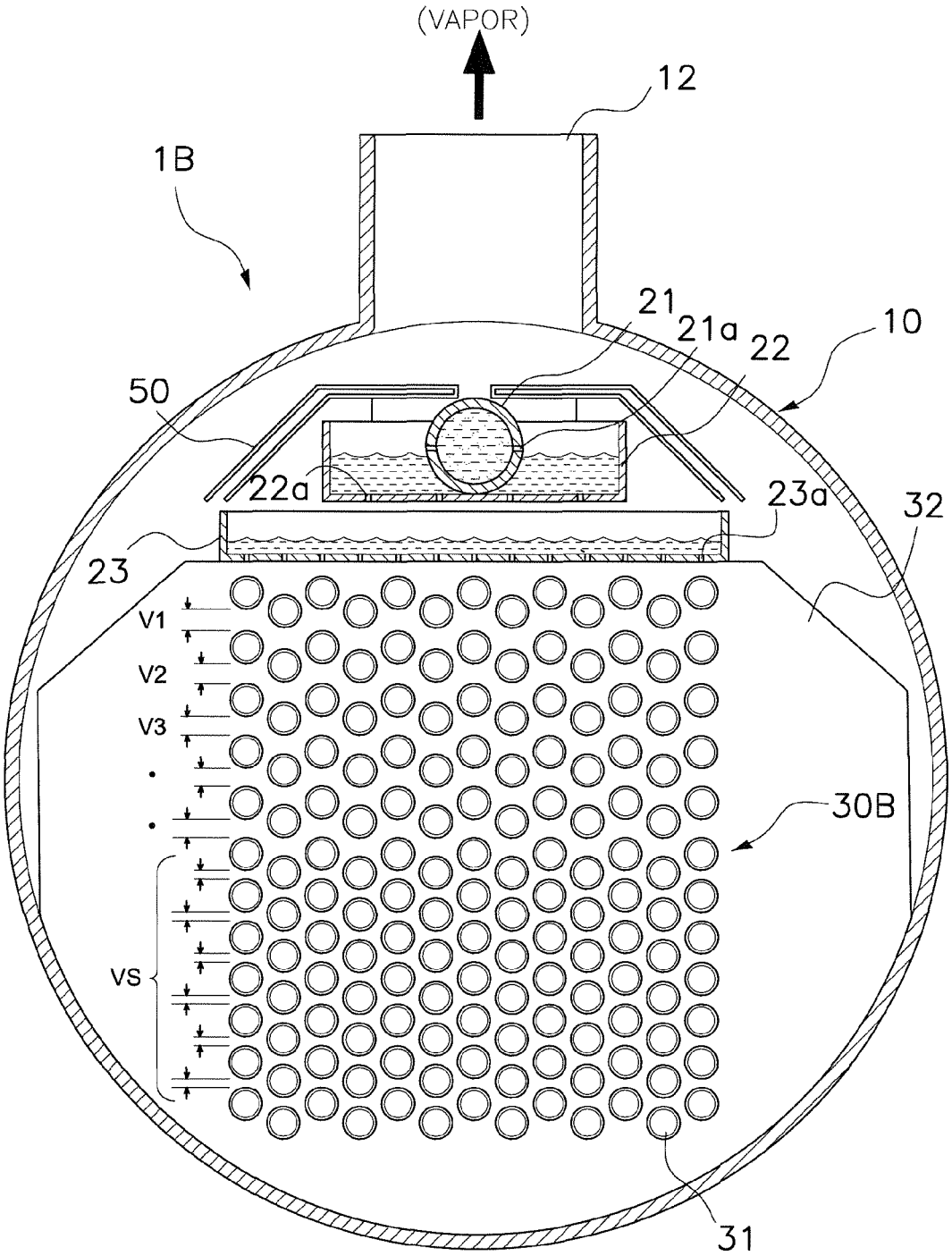
FIG. 10 is a simplified transverse cross sectional view of the heat exchanger illustrating a second modified example for an arrangement of a tube bundle according to the first embodiment of the present invention.

FIG. 10 is a simplified transverse cross sectional view of an evaporator 1B illustrating a second modified example for an arrangement of a tube bundle 30B according to the first embodiment. The evaporator 1B is basically the same as the evaporator 1A shown in FIG. 12 except for the geometry of the tube bundle 30B. More specifically, in this modified example, the heat transfer tubes 31 are arranged such that the vertical pitch (V1, V2, V3, . . . ) between adjacent ones of the heat transfer tubes 31 in each of the columns arranged in the upper region of the tube bundle gradually increases as it progresses upwardly, while the vertical pitch in the lower region is set to a constant pitch (VS), which is smaller than the vertical pitches in the upper region. With this modified example too, the similar effects as discussed above can be obtained with an even simpler structure.

Figure 11:
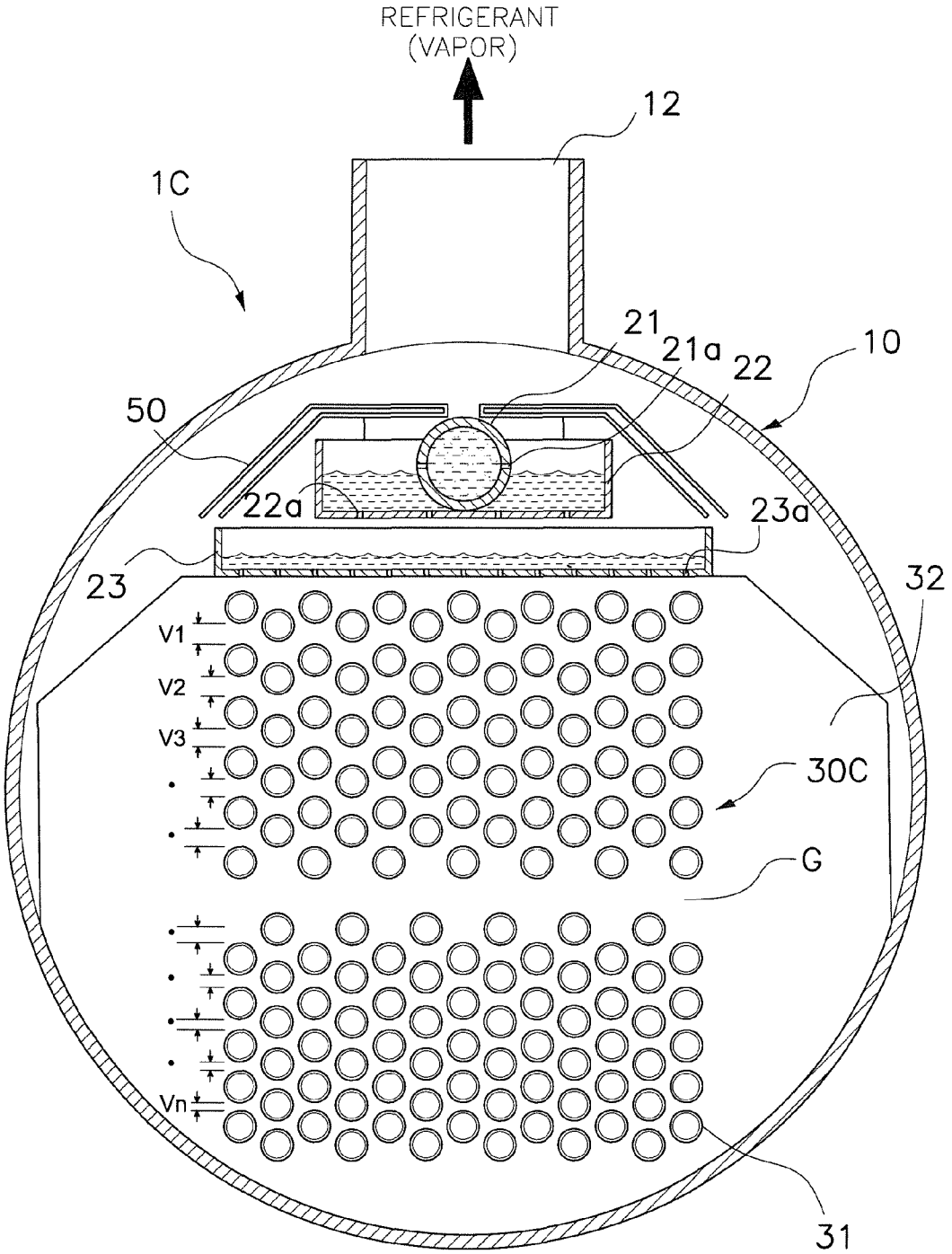
FIG. 11 is a simplified transverse cross sectional view of the heat exchanger illustrating a third modified example for an arrangement of a tube bundle according to the first embodiment of the present invention.

FIG. 11 is a simplified transverse cross sectional view of an evaporator 1C illustrating a third modified example for an arrangement of a tube bundle 30C according to the first embodiment. The evaporator 1C is basically the same as the evaporator 1 shown in FIG. 7 except that a gap G is formed between the upper region of the tube bundle 30C and the lower region of the tube bundle 30C as shown in FIG. 11.

Figure 12:
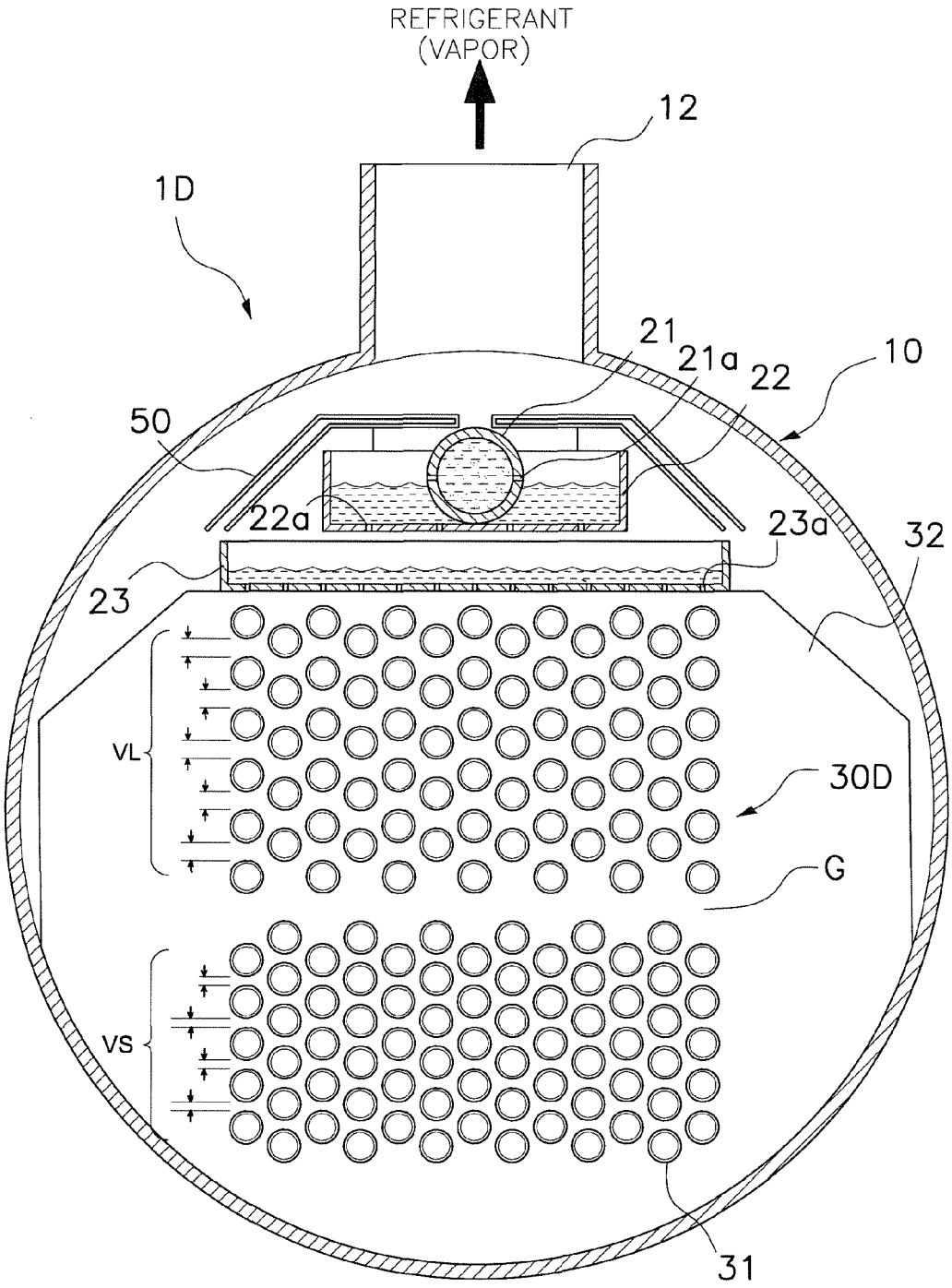
FIG. 12 is a simplified transverse cross sectional view of the heat exchanger illustrating a fourth modified example for an arrangement of a tube bundle according to the first embodiment of the present invention.

FIG. 12 is a simplified transverse cross sectional view of an evaporator 1D illustrating a fourth modified example for an arrangement of a tube bundle 30D according to the first embodiment. The evaporator 1C is basically the same as the evaporator 1A shown in FIG. 9 except that a gap G is formed between the upper region of the tube bundle 30D and the lower region of the tube bundle 30D as shown in FIG. 12.

Figure 13:
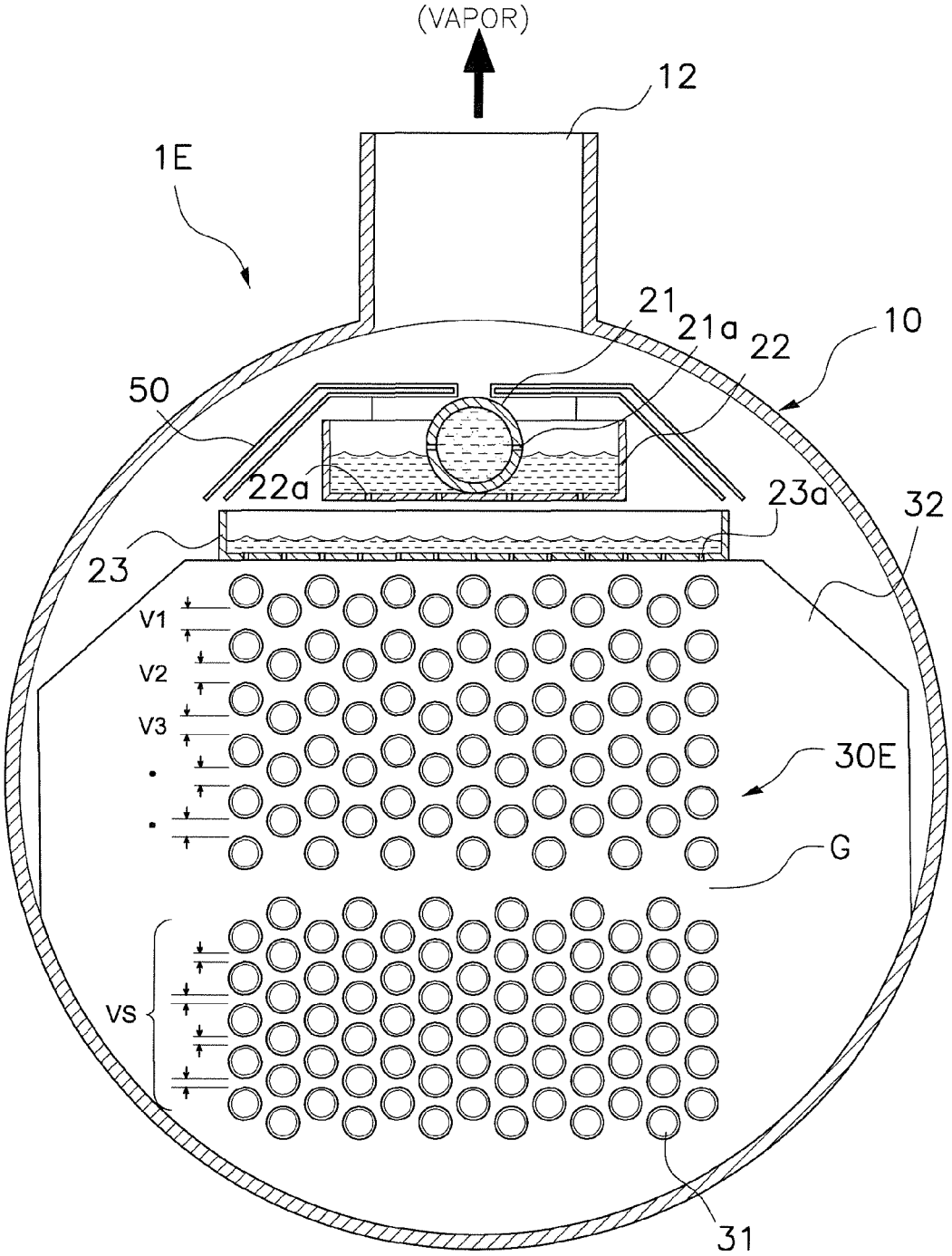
FIG. 13 is a simplified transverse cross sectional view of the heat exchanger illustrating a fifth modified example for an arrangement of a tube bundle according to the first embodiment of the present invention.

FIG. 13 is a simplified transverse cross sectional view of an evaporator 1E illustrating a fifth modified example for an arrangement of a tube bundle 30E according to the first embodiment. The evaporator 1E is basically the same as the evaporator 1B shown in FIG. 10 except that a gap G is formed between the upper region of the tube bundle 30E and the lower region of the tube bundle 30E as shown in FIG. 13.

In the examples shown in FIGS. 11 to 13, the refrigerant vapor formed in the lower region of the tube bundle 30C, 30D or 30E flows transversely in the gap G toward outside of the tube bundle 30C, 30D or 30E. Therefore, the vapor velocity in the upper region of the tube bundle 30C, 30D or 30E can be further reduced.

Second Embodiment

Referring now to FIGS. 14 to 19, an evaporator 101 in accordance with a second embodiment will now be explained. In view of the similarity between the first and second embodiments, the parts of the second embodiment that are identical to the parts of the first embodiment will be given the same reference numerals as the parts of the first embodiment. Moreover, the descriptions of the parts of the second embodiment that are identical to the parts of the first embodiment may be omitted for the sake of brevity.

The evaporator 101 according to the second embodiment is basically the same as the evaporator 1 of the first embodiment illustrated in FIGS. 2 to 7 except for the geometry of a tube bundle 130. In the second embodiment, the heat transfer tubes 31 are arranged such that a horizontal pitch between adjacent ones of the columns is larger in an outer region of the tube bundle 130 than in an inner region of the tube bundle 130.

Figure 14:
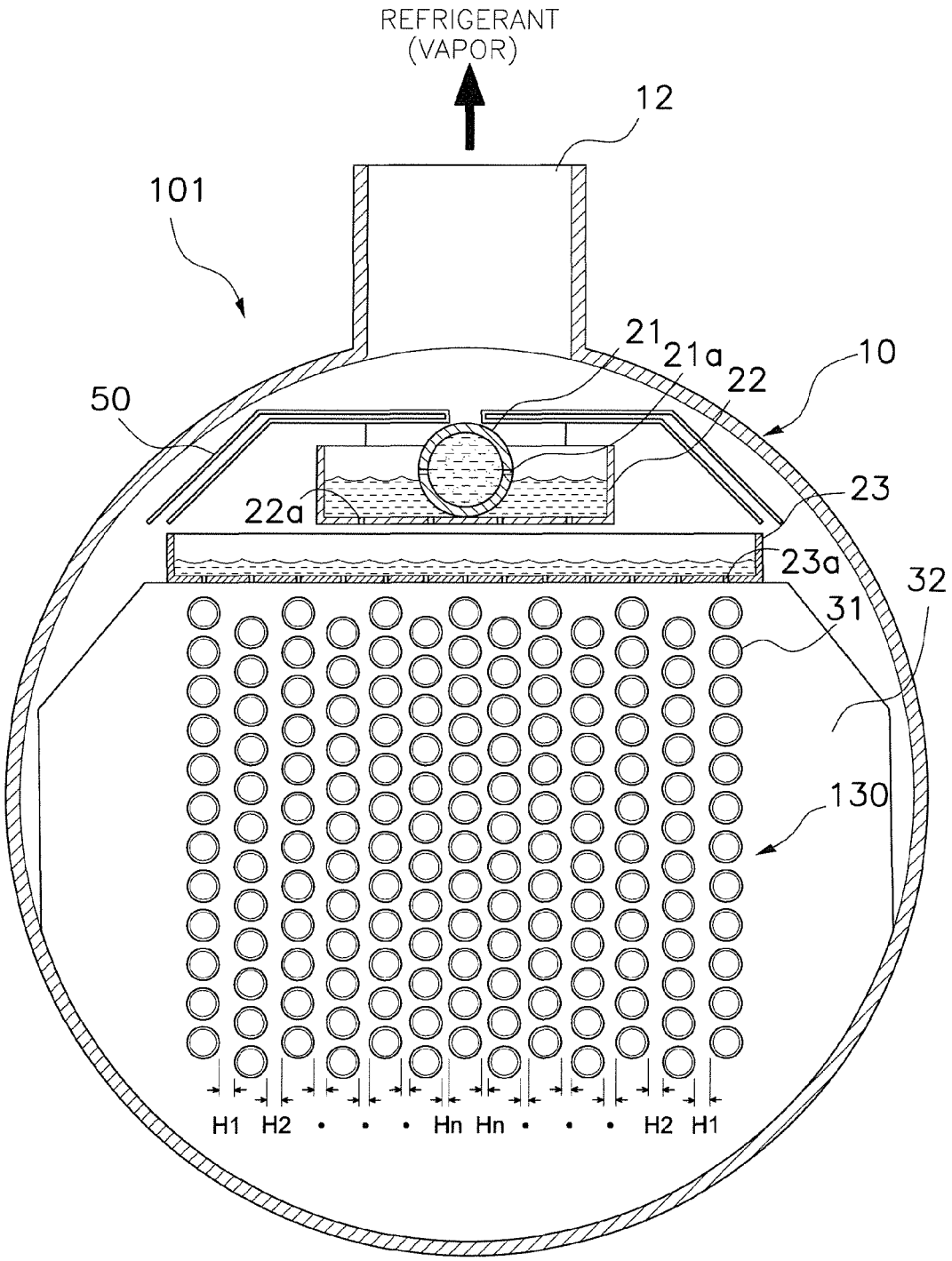
FIG. 14 is a simplified transverse cross sectional view of a heat exchanger according to a second embodiment of the present invention.

More specifically, in the example shown in FIG. 14, the horizontal pitch (H1, H2, . . . Hn) between adjacent ones of the columns of the heat transfer tubes 31 gradually increases from a minimum horizontal pitch Hn in the inner region to a maximum horizontal pitch H1 in the outer region of the tube bundle 130. Since the horizontal pitch is enlarged in the outer region of the tube bundle 130, the vapor flow is encouraged to flow upwardly (vertically) in the outer region of the tube bundle 130. As a result, the vapor velocity of the cross flow can be suppressed so that the vapor velocity does not exceed a prescribed maximum velocity at any location.

The arrangement of the tube bundle 130 is not limited to the ones illustrated in FIG. 14. It will be apparent to those skilled in the art from this disclosure that various changes and modifications can be made herein without departing from the scope of the invention. Several modified examples will be explained with reference to FIGS. 15 to 19.

Figure 15:
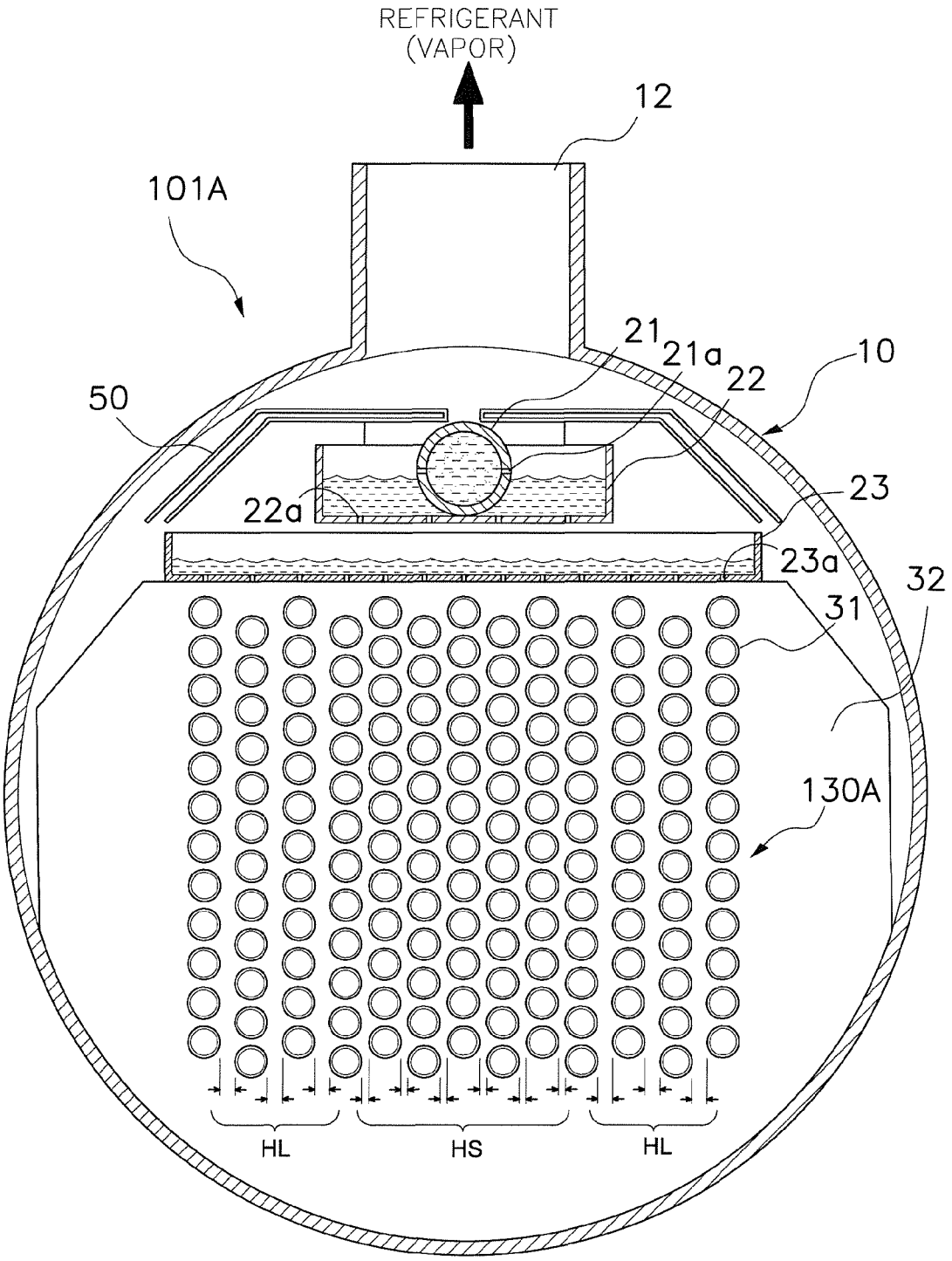
FIG. 15 is a simplified transverse cross sectional view of the heat exchanger illustrating a first modified example for an arrangement of a tube bundle according to the second embodiment of the present invention.

FIG. 15 is a simplified transverse cross sectional view of an evaporator 101A illustrating a first modified example for an arrangement of a tube bundle 130A according to the second embodiment. The evaporator 101A is basically the same as the evaporator 101 illustrated in FIG. 14 except for the geometry of the tube bundle 130A. More specifically, the heat transfer tubes 31 are arranged such that a horizontal pitch between adjacent ones of the columns in the inner region of the tube bundle 130A is a first horizontal pitch HS, and the horizontal pitch between adjacent ones of the columns in the outer region of the tube bundle 130A is a second horizontal pitch HL that is larger than the first horizontal pitch HS. With this modified example, the similar effects as discussed above can be obtained with an even simpler structure.

Figure 16:
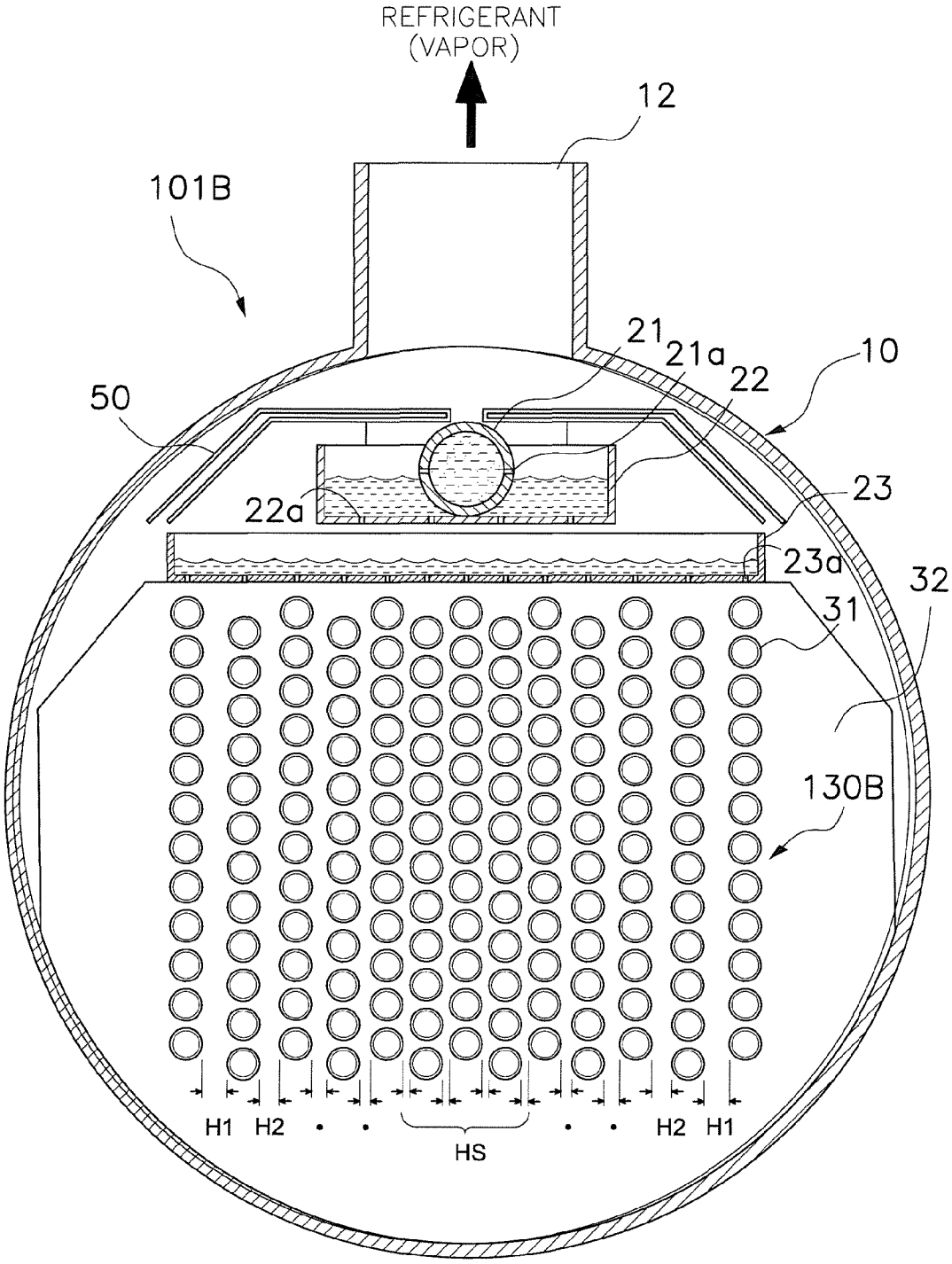
FIG. 16 is a simplified transverse cross sectional view of the heat exchanger illustrating a second modified example for an arrangement of a tube bundle according to the second embodiment of the present invention.

FIG. 16 is a simplified transverse cross sectional view of an evaporator 101B illustrating a second modified example for an arrangement of a tube bundle 130B according to the second embodiment. The evaporator 101B is basically the same as the evaporator 101A shown in FIG. 15 except for the geometry of the tube bundle 130B. More specifically, the heat transfer tubes 31 are arranged such that the horizontal pitch (H1, H2, . . . ) between adjacent ones of the columns in the outer region of the tube bundle 130B gradually increases towards outside of the tube bundle 130B, while the horizontal pitch in the inner region is set to a constant pitch (HS), which is smaller than the horizontal pitches in the outer region. With this modified example too, the similar effects as discussed above can be obtained with an even simpler structure.

Figure 17:
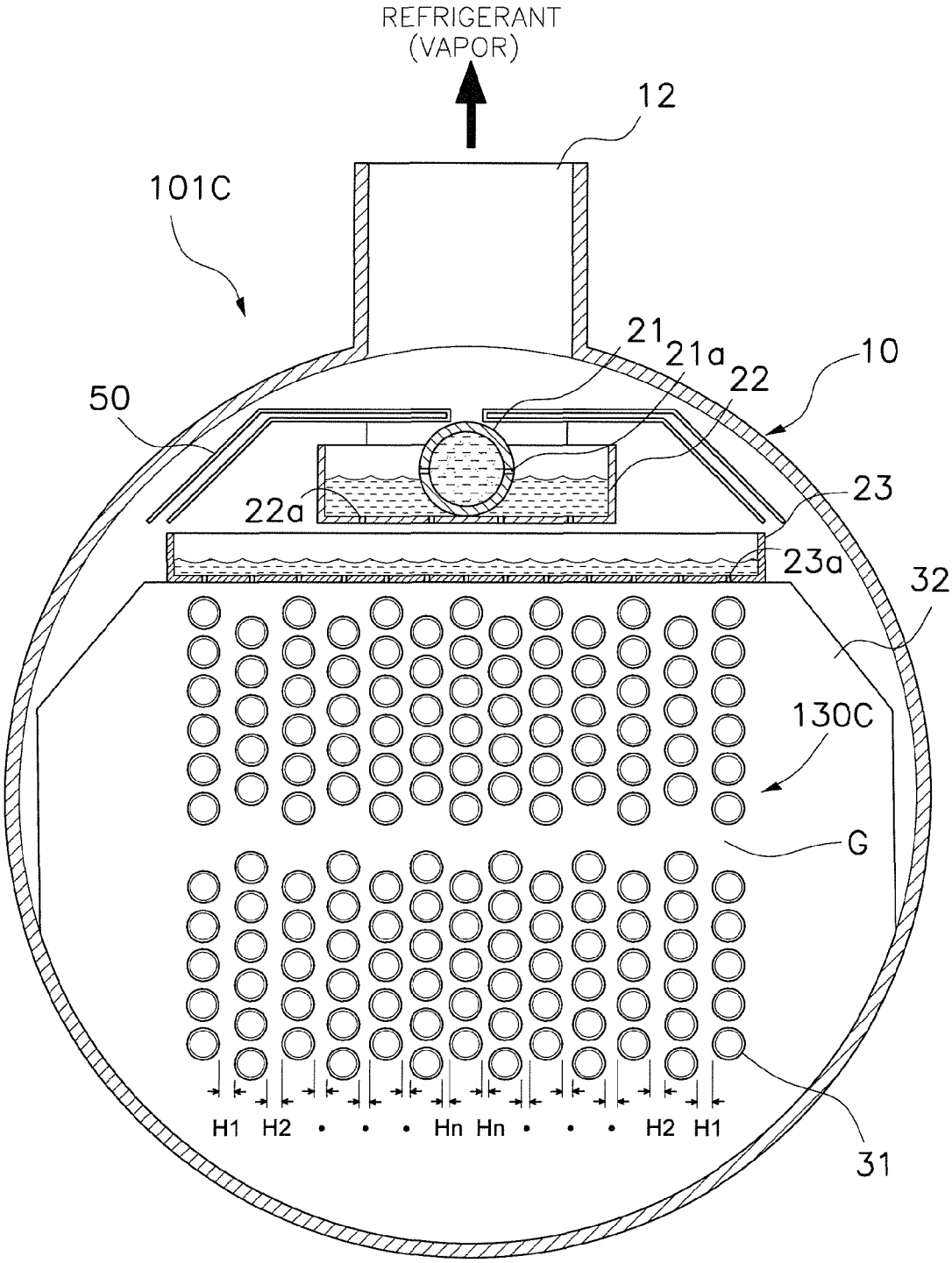
FIG. 17 is a simplified transverse cross sectional view of the heat exchanger illustrating a third modified example for an arrangement of a tube bundle according to the second embodiment of the present invention.

FIG. 17 is a simplified transverse cross sectional view of an evaporator 101C illustrating a third modified example for an arrangement of a tube bundle 130C according to the second embodiment. The evaporator 101C is basically the same as the evaporator 101 shown in FIG. 14 except that a gap G is formed between the upper region of the tube bundle 130C and the lower region of the tube bundle 130C as shown in FIG. 17.

Figure 18:
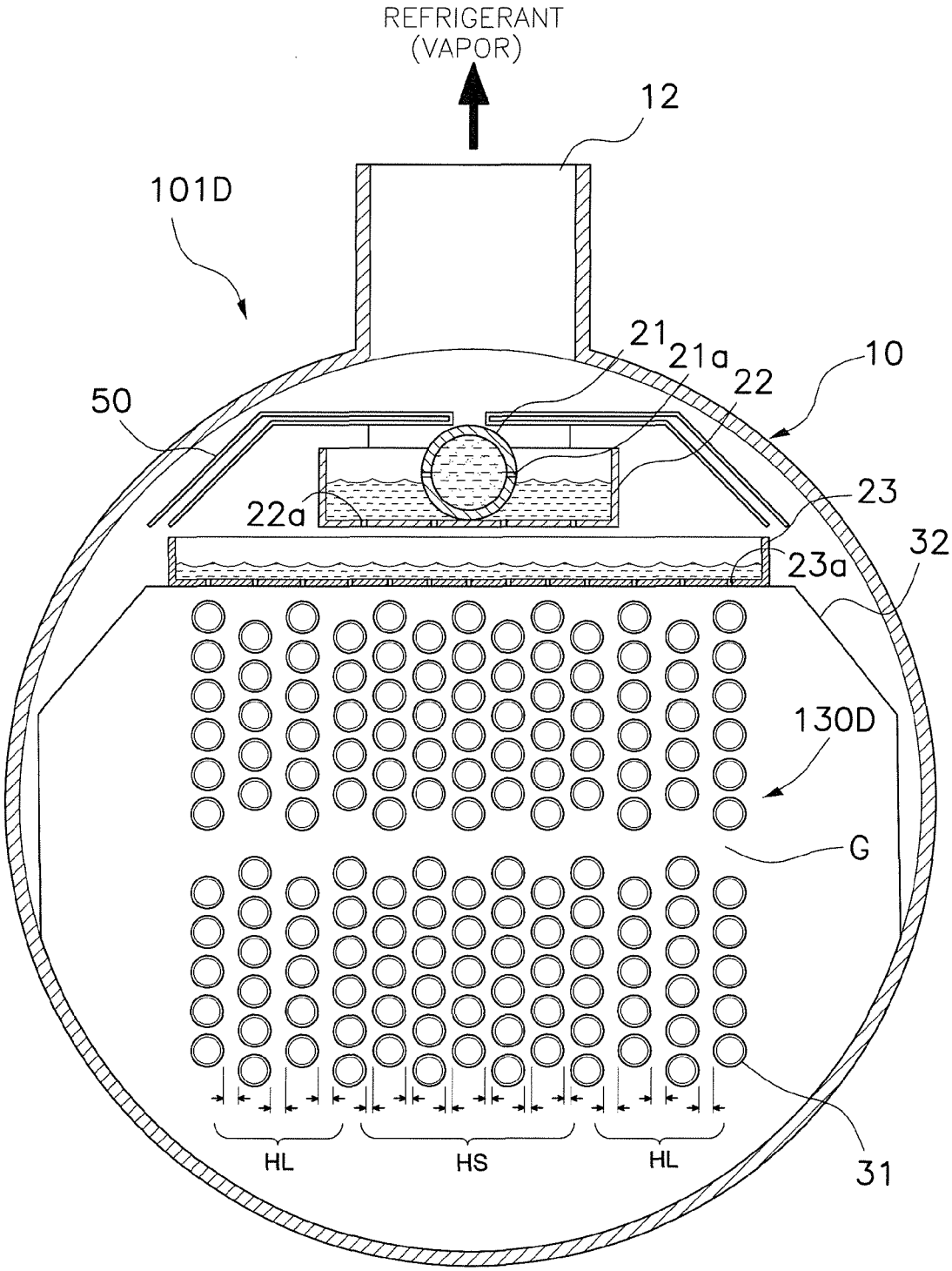
FIG. 18 is a simplified transverse cross sectional view of the heat exchanger illustrating a fourth modified example for an arrangement of a tube bundle according to the second embodiment of the present invention.

FIG. 18 is a simplified transverse cross sectional view of an evaporator 101D illustrating a fourth modified example for an arrangement of a tube bundle 130D according to the second embodiment. The evaporator 101D is basically the same as the evaporator 101A shown in FIG. 15 except that a gap G is formed between the upper region of the tube bundle 130D and the lower region of the tube bundle 130D as shown in FIG. 18.

Figure 19:
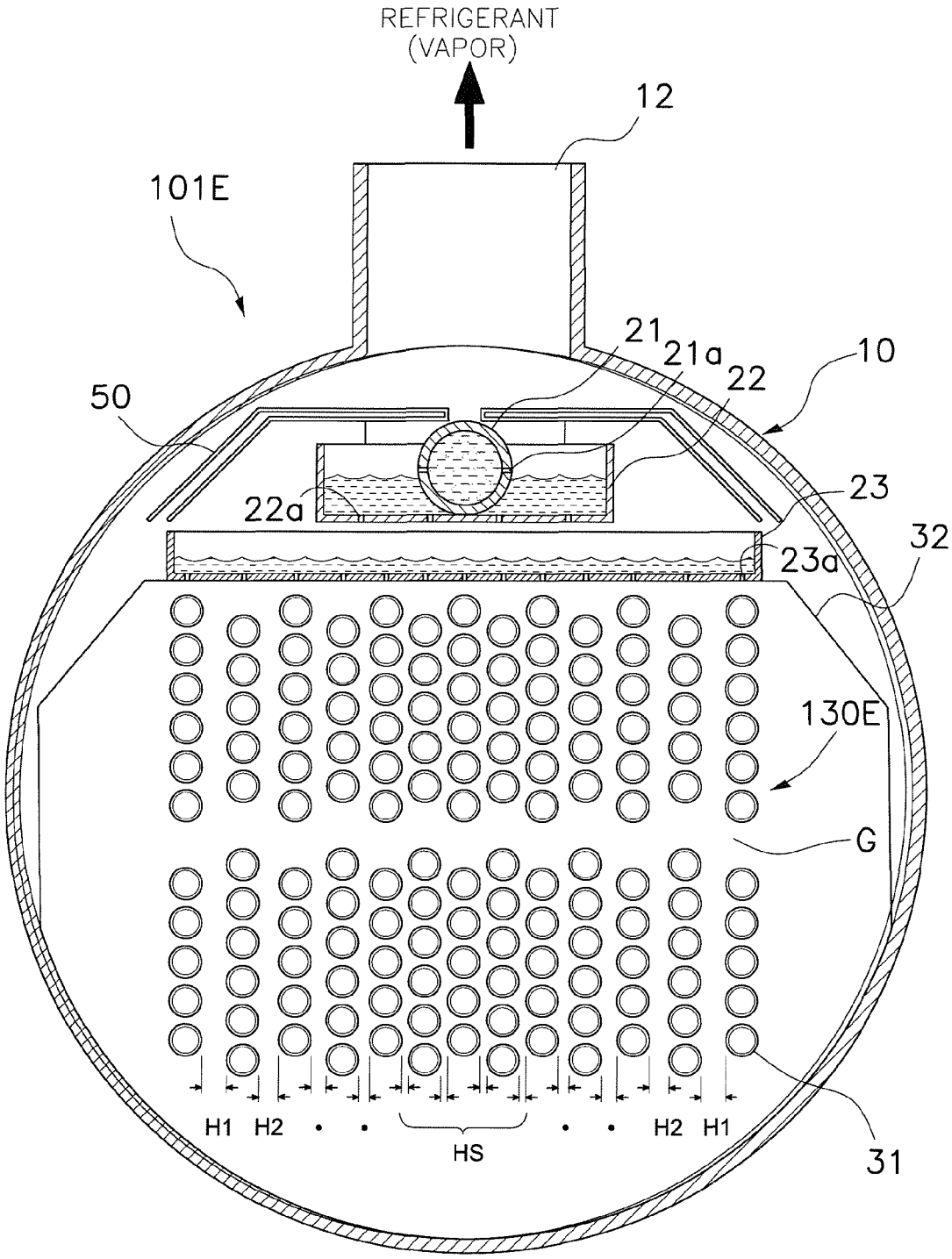
FIG. 19 is a simplified transverse cross sectional view of the heat exchanger illustrating a fifth modified example for an arrangement of a tube bundle according to the second embodiment of the present invention.

FIG. 19 is a simplified transverse cross sectional view of an evaporator 101E illustrating a fifth modified example for an arrangement of a tube bundle 130E according to the second embodiment. The evaporator 101E is basically the same as the evaporator 101B shown in FIG. 16 except that a gap G is formed between the upper region of the tube bundle 130E and the lower region of the tube bundle 130E as shown in FIG. 19.

In the examples shown in FIGS. 17 to 19, the refrigerant vapor formed in the lower region of the tube bundle 130C, 130D or 130E flows transversely in the gap G toward outside of the tube bundle 130C, 130D or 130E. Therefore, the vapor velocity in the upper region of the tube bundle 130C, 130D or 130E can be further reduced.

Third Embodiment

Referring now to FIGS. 20 to 25, an evaporator 201 in accordance with a third embodiment will now be explained. In view of the similarity between the first, second and third embodiments, the parts of the third embodiment that are identical to the parts of the first or second embodiment will be given the same reference numerals as the parts of the first or second embodiment. Moreover, the descriptions of the parts of the third embodiment that are identical to the parts of the first or second embodiment may be omitted for the sake of brevity.

The evaporator 201 according to the second embodiment is basically the same as the evaporator 1 of the first embodiment illustrated in FIGS. 2 to 7 except for the geometry of a tube bundle 230. In the third embodiment, a vertical pitch between adjacent ones of the heat transfer tubes 31 in each of the columns is set to be larger in an upper region of the tube bundle 230 than in a lower region of the tube bundle 230. In addition, a horizontal pitch between adjacent ones of the columns is set to be larger in an outer region of the tube bundle 230 than in an inner region of the tube bundle 230.

More specifically, in the example shown in FIG. 14, the heat transfer tubes 31 are arranged such that a vertical pitch between adjacent ones of the heat transfer tubes 31 in each of the columns in the lower region of the tube bundle 230 is a first vertical pitch VS, and a vertical pitch between adjacent ones of the heat transfer tubes 31 in each of the columns in the upper region of the tube bundle 230 is a second vertical pitch VL that is larger than the first vertical pitch VS. In addition, the heat transfer tubes 31 are arranged such that a horizontal pitch between adjacent ones of the columns in the inner region of the tube bundle 230 is a first horizontal pitch HS, and the horizontal pitch between adjacent ones of the columns in the outer region of the tube bundle 230 is a second horizontal pitch HL that is larger than the first horizontal pitch HS. By enlarging the vertical pitch in an upper region of the tube bundle 230, the cross sectional area of passages through which the cross flow passes can be increased. Therefore, increase in the vapor velocity in the upper region of the tube bundle 30 can be suppressed with a simple structure. Moreover, since the horizontal pitch is enlarged in the outer region of the tube bundle 230, the vapor flow is encouraged to flow upwardly (vertically) in the outer region of the tube bundle 230. As a result, the vapor velocity of the cross flow can be suppressed so that the vapor velocity does not exceed a prescribed maximum velocity at any location. Accordingly, with the arrangement of the tube bundle 230 according to the first embodiment, the vapor velocity in the tube bundle 230 does not exceed a prescribed maximum velocity at any location of the tube bundle 230. Thus, disruption of vertical flow of the liquid refrigerant by high velocity cross flow can be eliminated, thereby preventing formation of dry patches in the heat transfer tubes 31. Moreover, since the velocity of the vapor flow can be suppressed according to the first embodiment, occurrence of the entrained liquid droplets can also be reduced.

Figure 20:
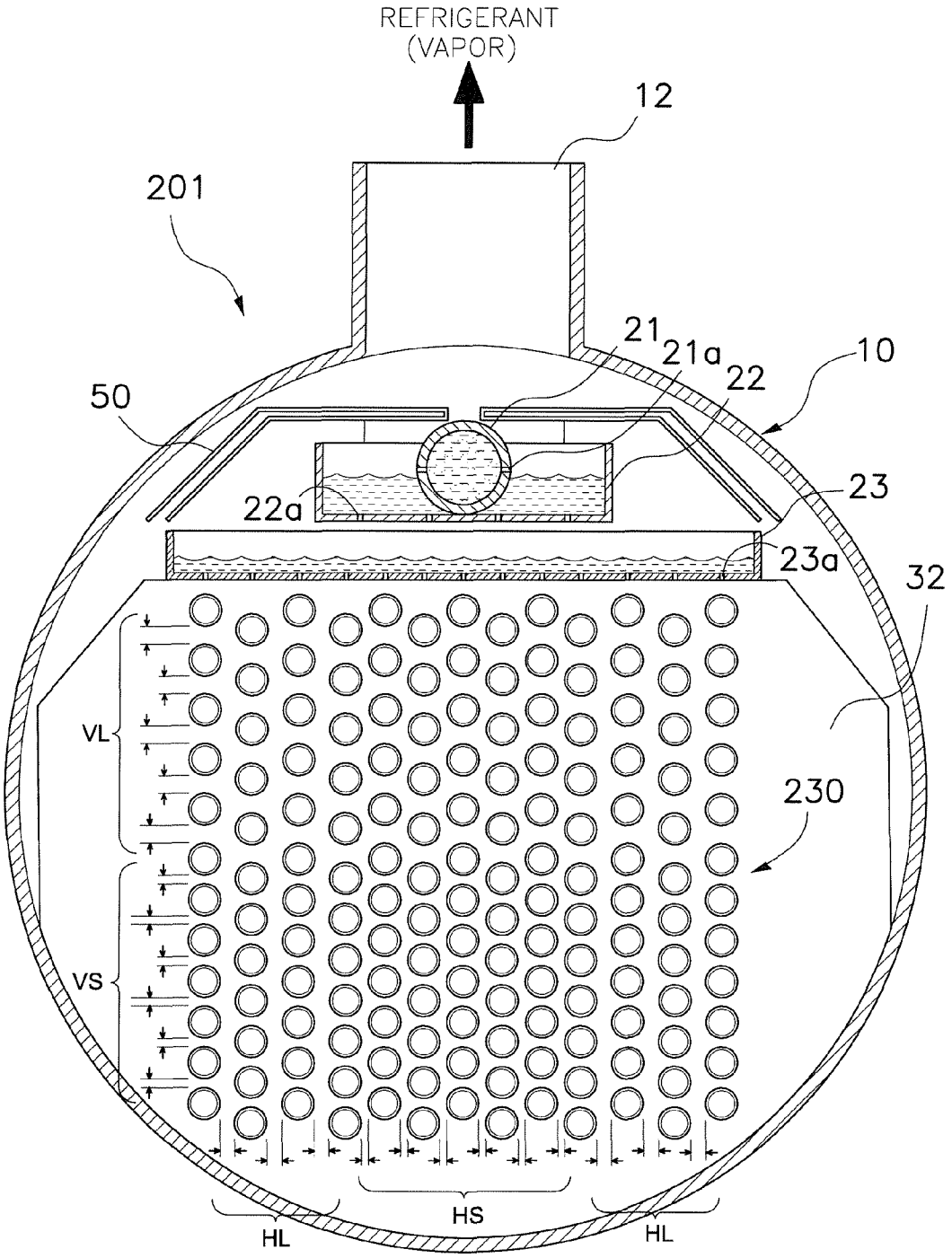
FIG. 20 is a simplified transverse cross sectional view of a heat exchanger according to a third embodiment of the present invention.

The arrangement of the tube bundle 230 is not limited to the ones illustrated in FIG. 20. It will be apparent to those skilled in the art from this disclosure that various changes and modifications can be made herein without departing from the scope of the invention. Several modified examples will be explained with reference to FIGS. 21 to 25.

Figure 21:
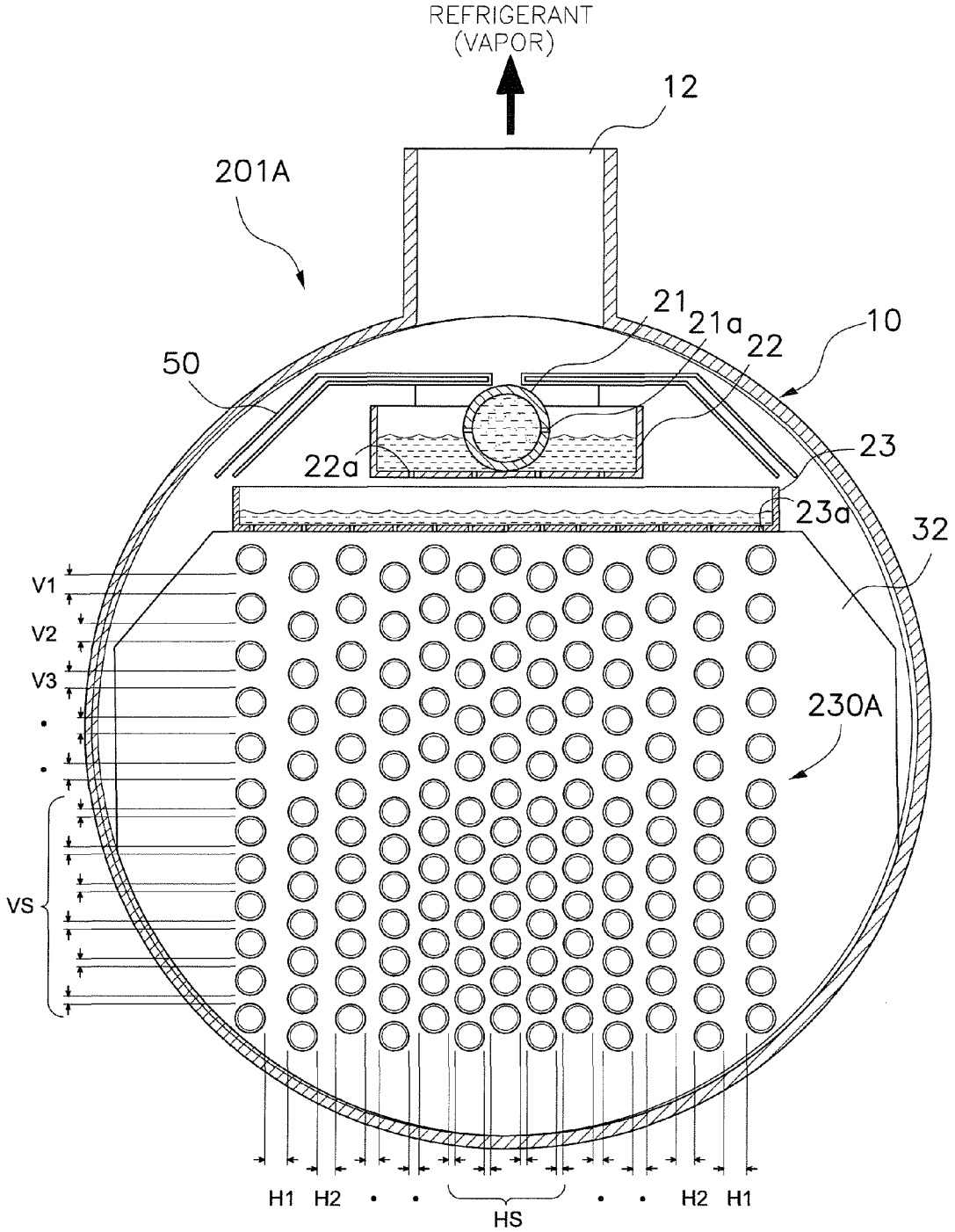
FIG. 21 is a simplified transverse cross sectional view of the heat exchanger illustrating a first modified example for an arrangement of a tube bundle according to the third embodiment of the present invention.

FIG. 21 is a simplified transverse cross sectional view of an evaporator 201A illustrating a first modified example for an arrangement of a tube bundle 230A according to the third embodiment. The evaporator 201A is basically the same as the evaporator 201 illustrated in FIG. 20 except for the geometry of the tube bundle 230A. More specifically, in this modified example, the heat transfer tubes 31 are arranged such that the vertical pitch (V1, V2, V3, . . . ) between adjacent ones of the heat transfer tubes 31 in each of the columns arranged in the upper region of the tube bundle 230A gradually increases as it progresses upwardly, while the vertical pitch in the lower region of the tube bundle 230A is set to a constant pitch (VS), which is smaller than the vertical pitches in the upper region. Moreover, the heat transfer tubes 31 are arranged such that the horizontal pitch (H1, H2, . . . ) between adjacent ones of the columns in the outer region of the tube bundle 230A gradually increases towards outside of the tube bundle 230A, while the horizontal pitch in the inner region is set to a constant pitch (HS), which is smaller than the horizontal pitches in the outer region. With this modified example, the similar effects as discussed above can be obtained with an even simpler structure.

Figure 22:
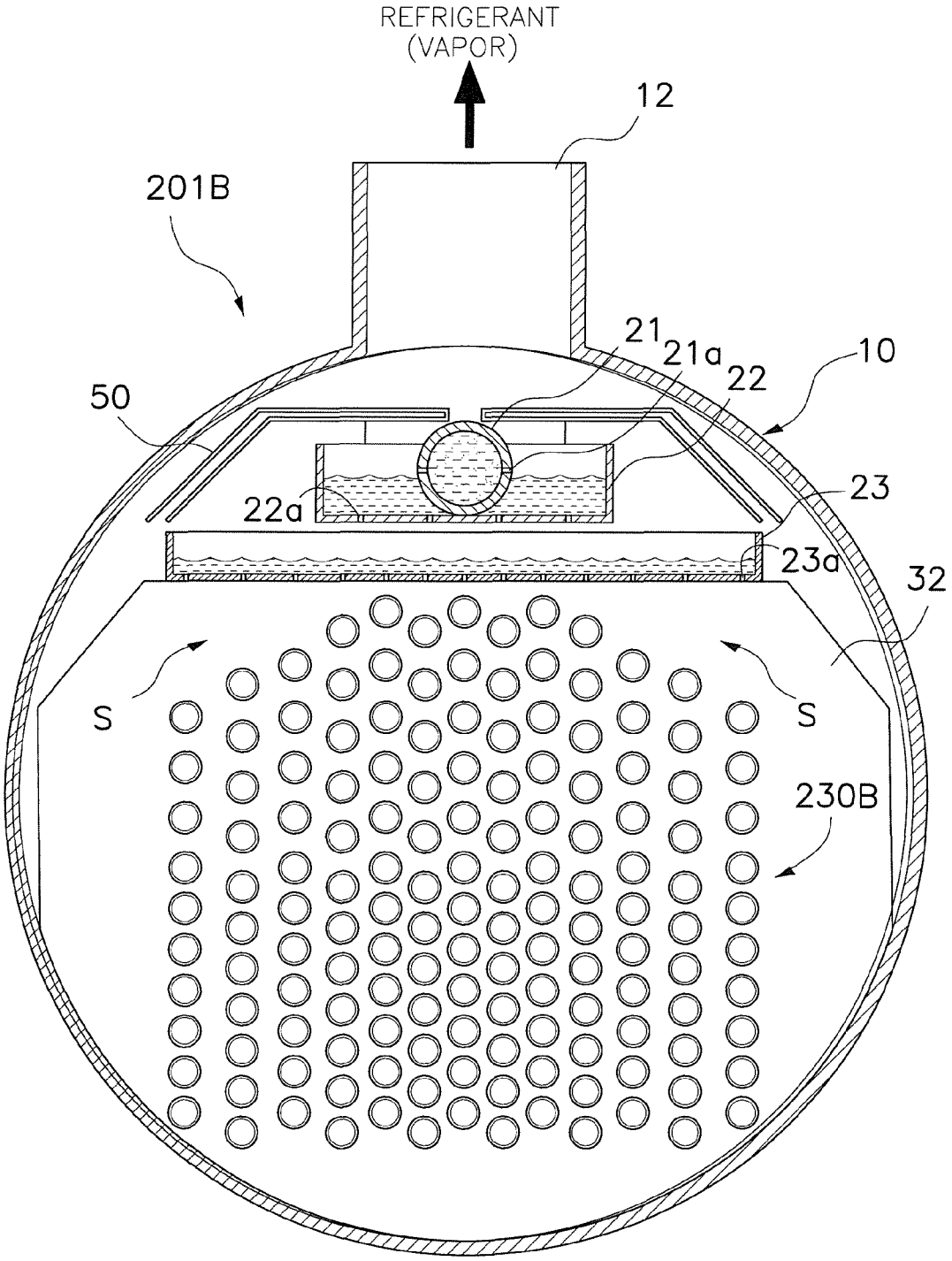
FIG. 22 is a simplified transverse cross sectional view of the heat exchanger illustrating a second modified example for an arrangement of a tube bundle according to the third embodiment of the present invention.

FIG. 22 is a simplified transverse cross sectional view of an evaporator 201B illustrating a second modified example for an arrangement of a tube bundle 230B according to the third embodiment. The evaporator 201B is basically the same as the evaporator 201A shown in FIG. 21 except that some of the heat transfer tubes 31 are eliminated in the outer upper region in the tube bundle 230B to form spaces S as shown in FIG. 22. In this example, the spaces S are formed between the distributing part 20 and the tube bundle 230B. Since the position and size of the discharge apertures (in this example, the discharge apertures 23*a* of the second tray part 23) are fixed, the liquid refrigerant can be reliably deposited onto the uppermost heat transfer tubes even when the spaces S are formed therebetween.

With the arrangement shown in FIG. 22, even wider vapor passage is formed in the outer upper region in the tube bundle 230B. Therefore, the increase in the vapor velocity in the upper region of the tube bundle 30 can be even further suppressed with a simple structure. Moreover, since entrainment of liquid droplets by the vapor most likely occurs in the outer upper region of the tube bundle 230B, occurrence of the entrained liquid droplets can also be reduced with the example shown in FIG. 22.

Figure 23:
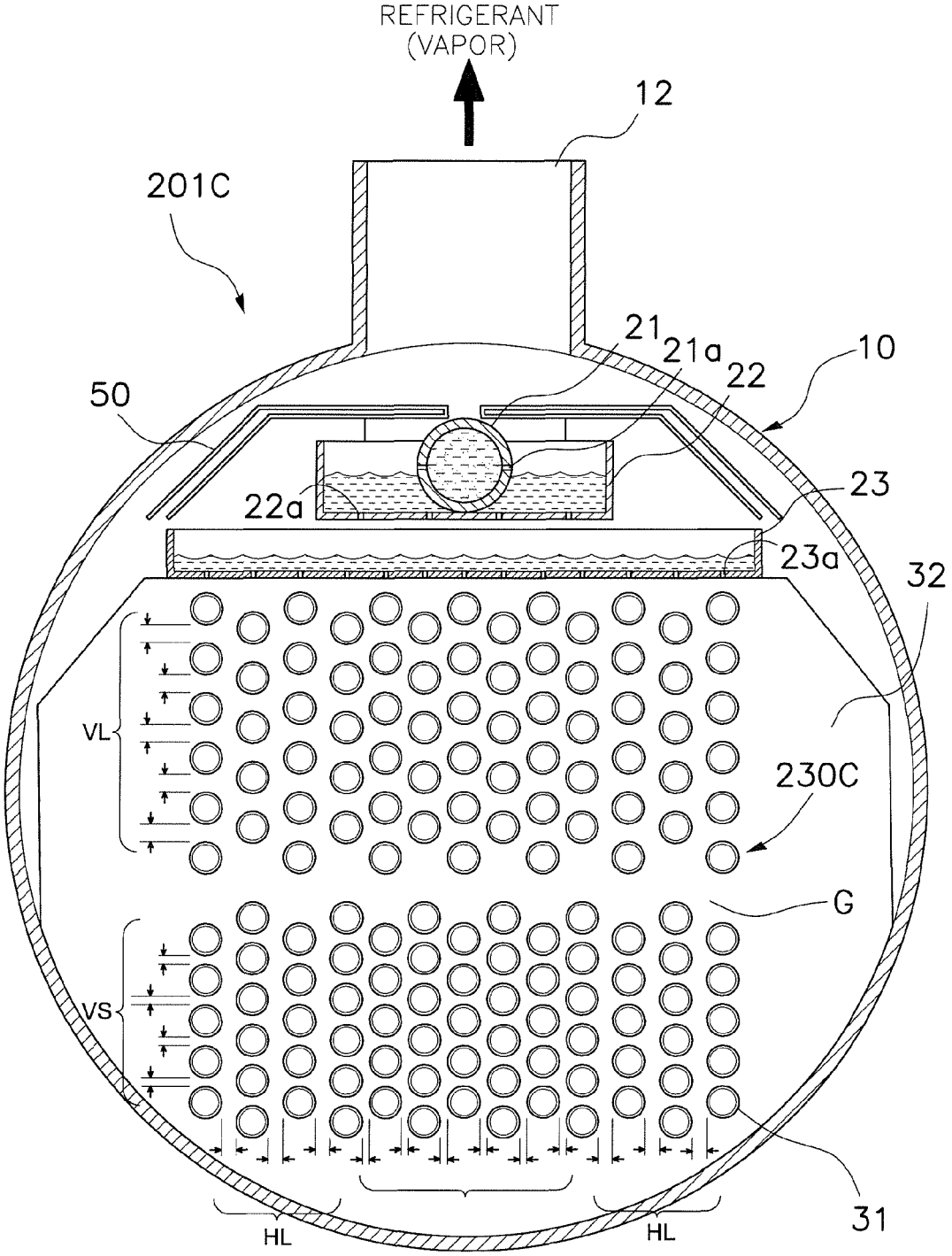
FIG. 23 is a simplified transverse cross sectional view of the heat exchanger illustrating a third modified example for an arrangement of a tube bundle according to the third embodiment of the present invention.

FIG. 23 is a simplified transverse cross sectional view of an evaporator 201C illustrating a fourth modified example for an arrangement of a tube bundle 230C according to the third embodiment. The evaporator 201C is basically the same as the evaporator 201 shown in FIG. 20 except that a gap G is formed between the heat transfer tubes 31 in the supply line group of the tube bundle 230C and the heat transfer tubes 31 in the return line group of the tube bundle 230C as shown in FIG. 23. The gap G is formed at a position corresponding to the water baffle 13*c* of the connection head member 13, and extends longitudinally throughout the evaporator 201C.

Figure 24:
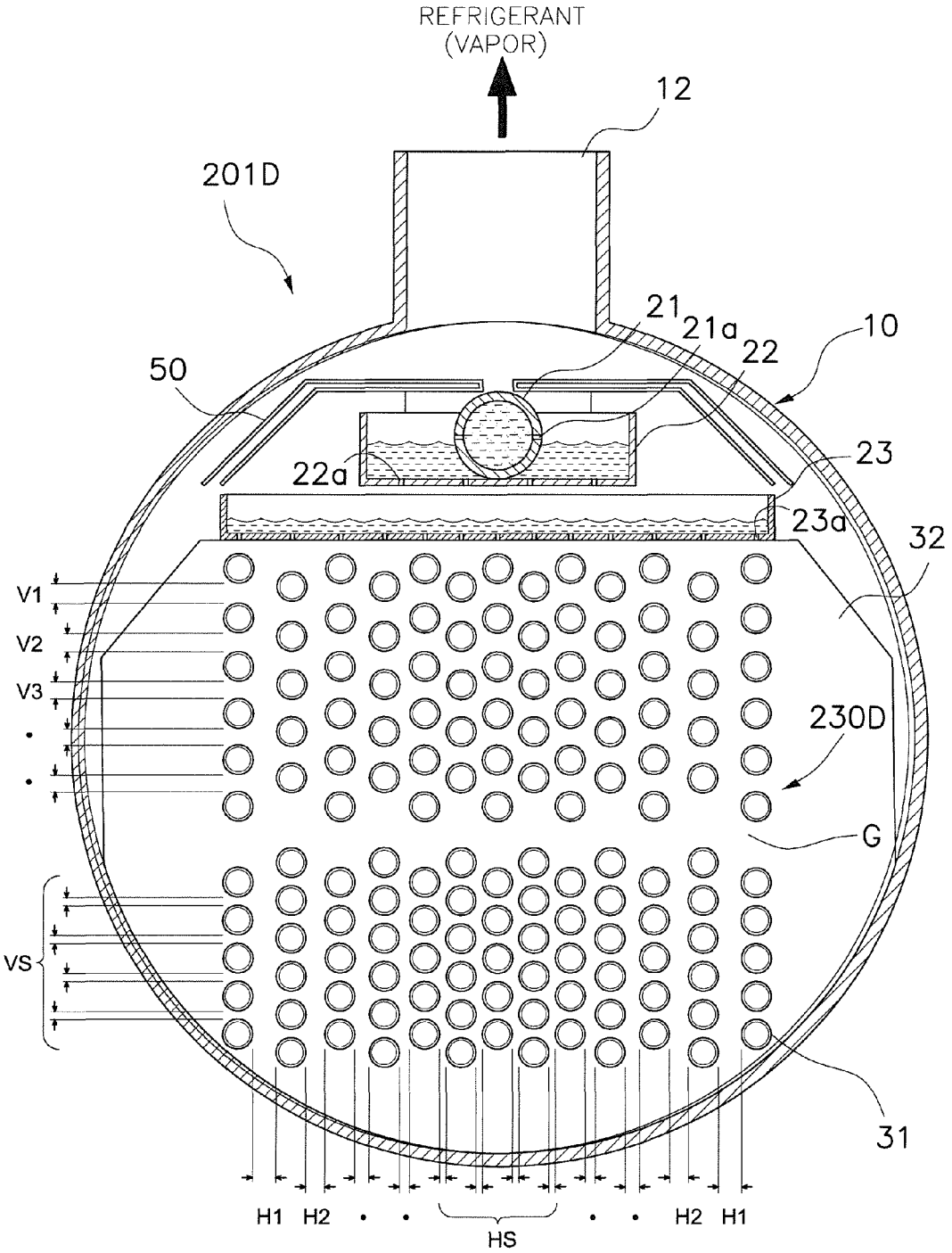
FIG. 24 is a simplified transverse cross sectional view of the heat exchanger illustrating a fourth modified example for an arrangement of a tube bundle according to the third embodiment of the present invention.

FIG. 24 is a simplified transverse cross sectional view of an evaporator 201D illustrating a fifth modified example for an arrangement of a tube bundle 230D according to the third embodiment. The evaporator 201D is basically the same as the evaporator 201A shown in FIG. 21 except that a gap G is formed between the upper region of the tube bundle 230D and the lower region of the tube bundle 230E as shown in FIG. 24.

Figure 25:
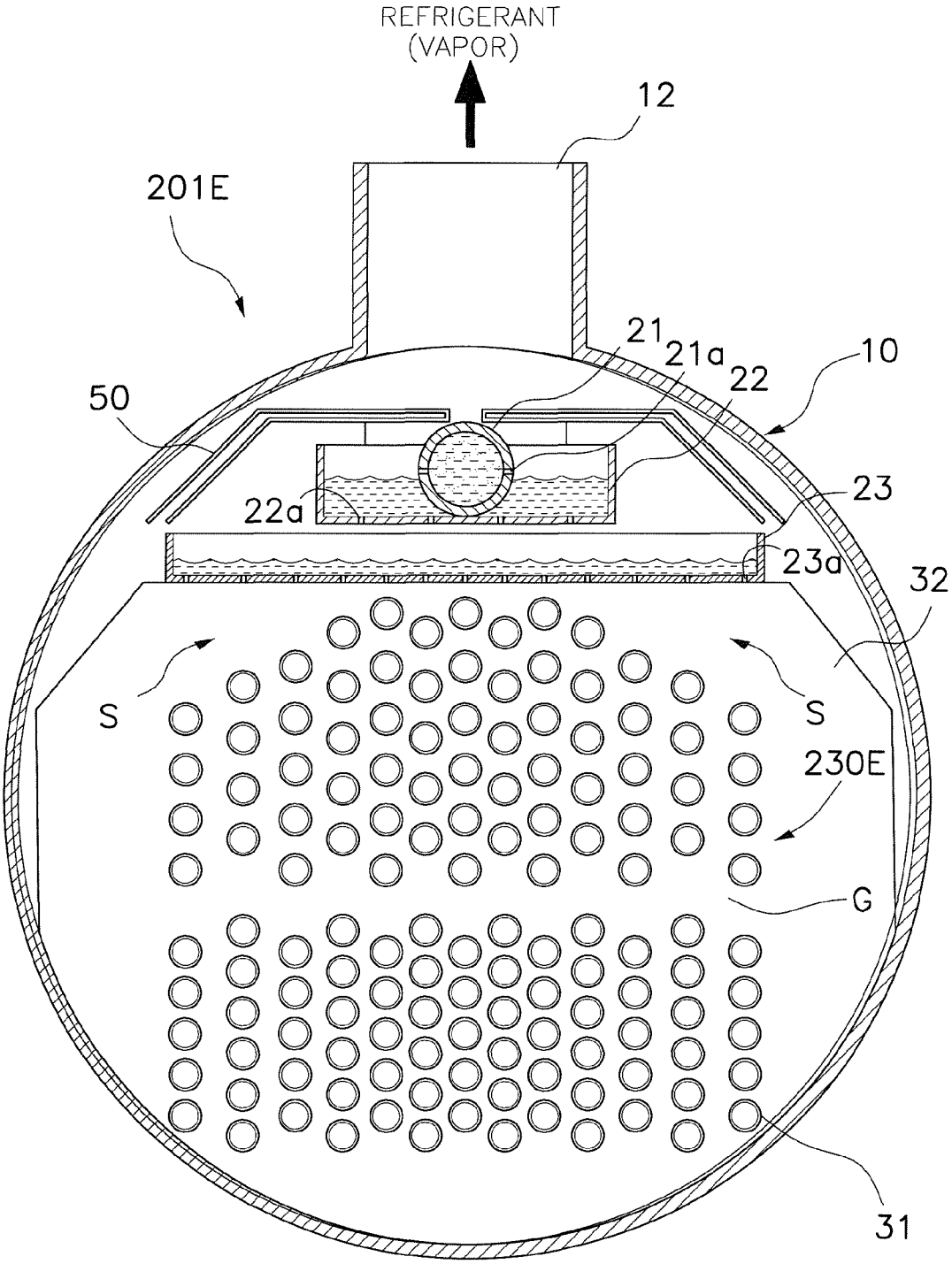
FIG. 25 is a simplified transverse cross sectional view of the heat exchanger illustrating a fifth modified example for an arrangement of a tube bundle according to the third embodiment of the present invention.

FIG. 25 is a simplified transverse cross sectional view of an evaporator 201E illustrating a fifth modified example for an arrangement of a tube bundle 230E according to the third embodiment. The evaporator 201E is basically the same as the evaporator 201B shown in FIG. 22 except that a gap G is formed between the upper region of the tube bundle 230E and the lower region of the tube bundle 230E as shown in FIG. 25.

In the examples shown in FIGS. 17 to 19, the refrigerant vapor formed in the lower region of the tube bundle 230C, 230D or 230E flows transversely in the gap G toward outside of the tube bundle 230C, 230D or 230E. Therefore, the vapor velocity in the upper region of the tube bundle 230C, 230D or 230E can be further reduced.

Fourth Embodiment

Figure 26:
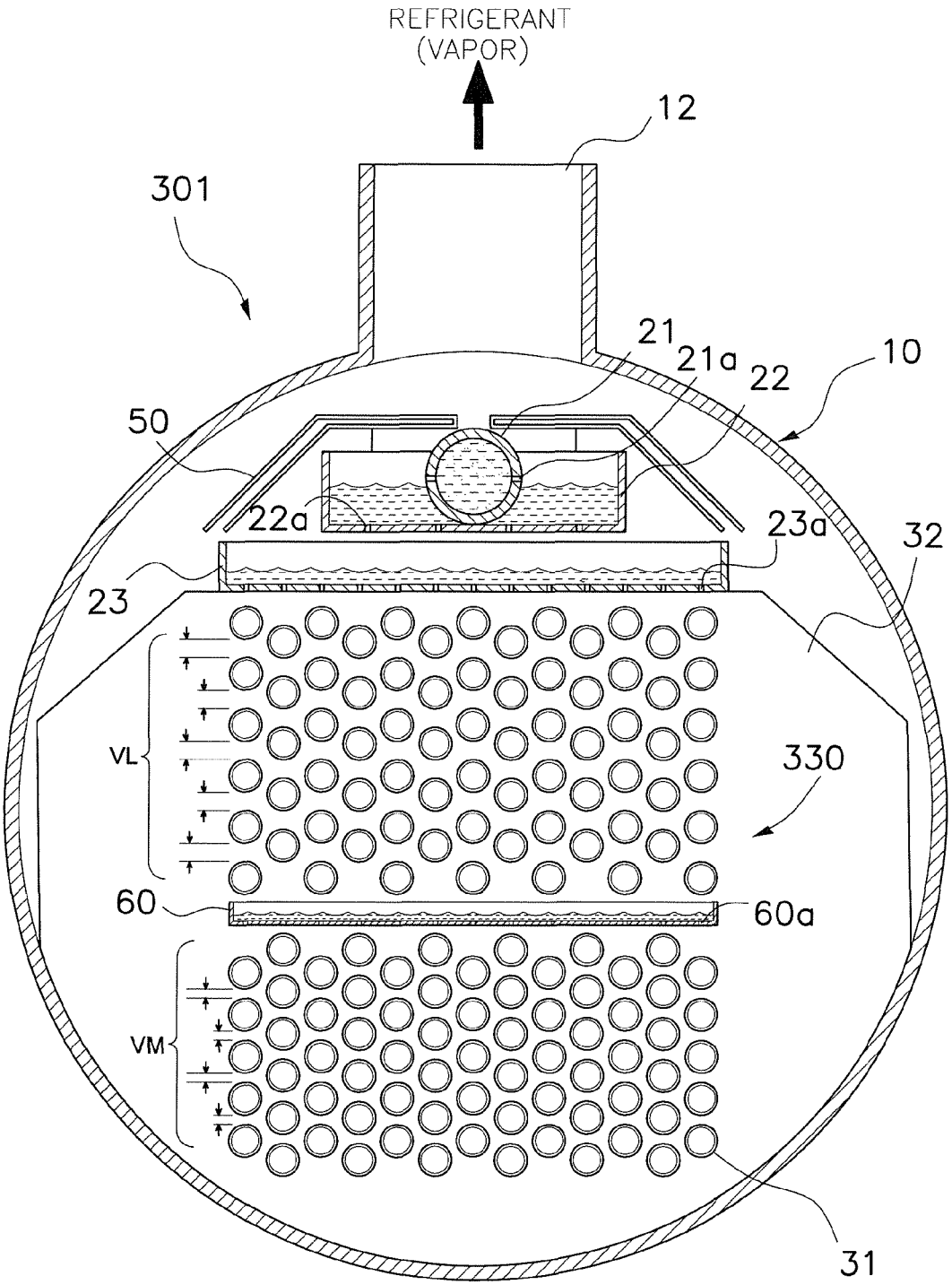
FIG. 26 is a simplified transverse cross sectional view of a heat exchanger according to a fourth embodiment of the present invention.
Figure 27:
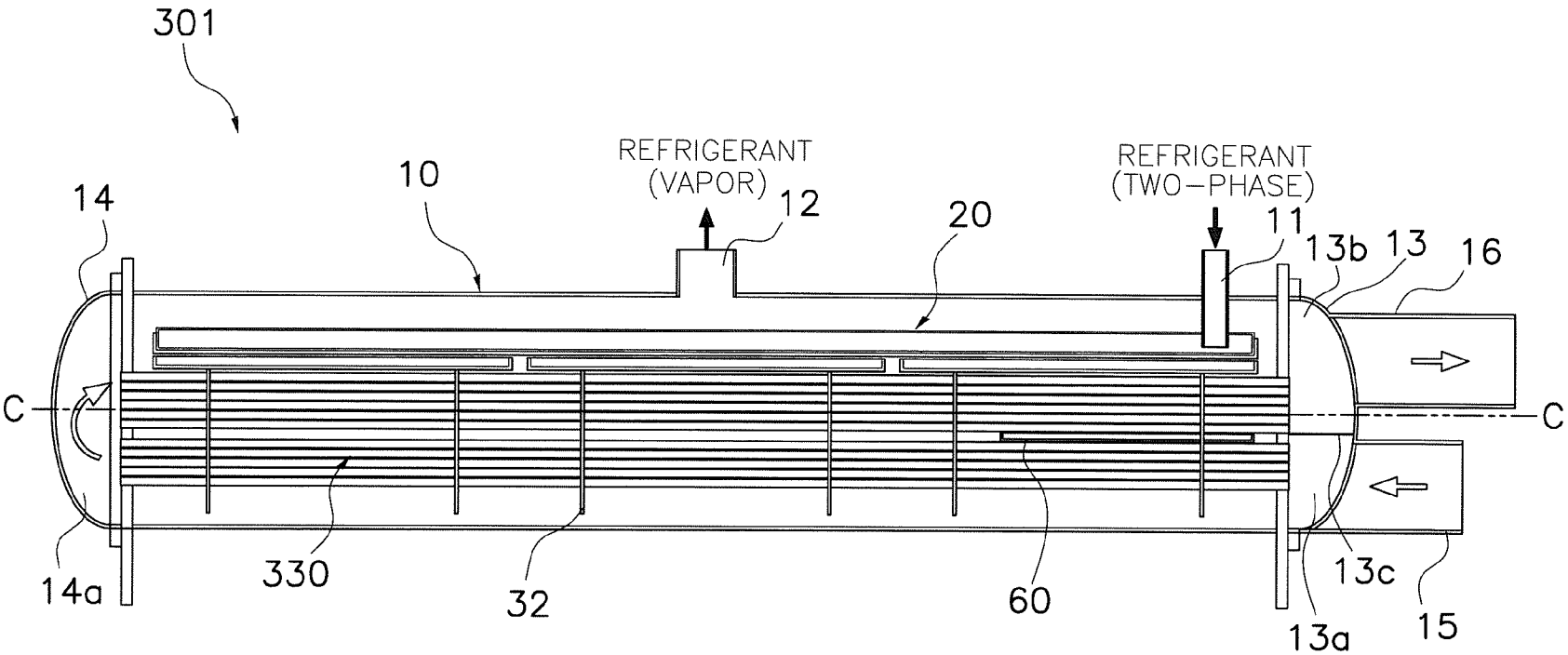
FIG. 27 is a simplified longitudinal cross sectional view of the heat exchanger according to the fourth embodiment of the present invention.

Referring now to FIGS. 26 and 27, an evaporator 301 in accordance with a fourth embodiment will now be explained. In view of the similarity between the first through fourth embodiments, the parts of the fourth embodiment that are identical to the parts of the first, second or third embodiment will be given the same reference numerals as the parts of the first, second or third embodiment. Moreover, the descriptions of the parts of the fourth embodiment that are identical to the parts of the first, second or third embodiment may be omitted for the sake of brevity.

In the evaporator 301 of the fourth embodiment, an intermediate tray part 60 is provided between the heat transfer tubes 31 in the supply line group and the heat transfer tubes 31 in the return line group. The intermediate tray part 60 includes a plurality of discharge apertures 60*a* through which the liquid refrigerant is discharged downwardly.

As discussed above, the evaporator 301 incorporates a two pass system in which the water first flows inside the heat transfer tubes 31 in the supply line group, which is disposed in a lower region of the tube bundle 330, and then is directed to flow inside the heat transfer tubes 31 in the return line group, which is disposed in an upper region of the tube bundle 330. Therefore, the water flowing inside the heat transfer tubes 31 in the supply line group near the inlet water chamber 13*a* has the highest temperature, and thus, a greater amount of heat transfer is required. For example, as shown in FIG. 27, the temperature of the water flowing inside the heat transfer tubes 31 near the inlet water chamber 13*a* is the highest. Therefore, a greater amount of heat transfer is required in the heat transfer tubes 31 near the inlet water chamber 13*a*. Once this region of the heat transfer tubes 31 dries up due to uneven distribution of the refrigerant from the distributing part 20, the evaporator 301 is forced to perform heat transfer by using limited surface areas of the heat transfer tubes 31 that are not dried up, and the evaporator 301 is held in equilibrium with the pressure at the time. In such a case, in order to rewet the dried up portions of the heat transfer tubes 31, more than the rated amount (e.g., twice as much) of the refrigerant charge will be required.

Therefore, in the fourth embodiment, the intermediate tray part 60 is disposed at a location above the heat transfer tubes 31 which requires a greater amount of heat transfer. The liquid refrigerant falling from above is once received by the intermediate tray part 60, and redistributed evenly toward the heat transfer tubes 31, which requires a greater amount of heat transfer. Accordingly, these portions of the heat transfer tubes 31 are prevented from drying up, and heat transfer can be efficiently performed by using substantially all surface areas of the exterior walls of the heat transfer tubes 31.

When the intermediate tray part 60 is used as in the fourth embodiment, it is preferable that a vertical pitch VM between the heat transfer tubes 31 in the lower region of the tube bundle 330 is set to be slightly larger than the vertical pitch VS used in the previous embodiments where no intermediate tray part is provided. More specifically, the intermediate tray part 60 partially blocks flow paths for vapor generated in the lower region of the tube bundle 330. Therefore, the vertical pitch VM is preferably set to be larger than the minimum vertical pitch to allow the vapor to flow outwardly and to prevent the flow velocity from exceeding a prescribed level in the lower region of the tube bundle 330. The vertical pitch VM in the lower region of the tube bundle 330 may be equal to or smaller than the vertical pitch VL in the upper region of the tube bundle 330. When the intermediate tray part 60 is disposed only at a portion of the longitudinal length of the tube bundle 330 as shown in FIG. 27, the vapor generated in the portion below the intermediate tray part 60 can also flow along the longitudinal direction and exit the tube bundle 330. Thus, in such a case, the vertical pitch VM in the lower region may be set to be about a half of the vertical pitch VL in the upper region.

Although, in the fourth embodiment, the intermediate tray part 60 is provided only partially with respect to the longitudinal direction of the tube bundle 330 as shown in FIG. 25, the intermediate tray part 60 or a plurality of intermediate tray parts 60 may be provided to extend substantially the entire longitudinal length of the tube bundle 330.

Similarly to the first embodiment, the arrangements for a tube bundle 330 and the trough part 40 in the fourth embodiment are not limited to the ones illustrated in FIG. 26. It will be apparent to those skilled in the art from this disclosure that various changes and modifications can be made herein without departing from the scope of the invention. For example, the intermediate tray part 60 can be combined in any of the arrangements shown in FIGS. 9-24.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. As used herein to describe the above embodiments, the following directional terms "upper", "lower", "above", "downward", "vertical", "horizontal", "below" and "transverse" as well as any other similar directional terms refer to those directions of an evaporator when a longitudinal center axis thereof is oriented substantially horizontally as shown in FIGS. 6 and 7. Accordingly, these terms, as utilized to describe the present invention should be interpreted relative to an evaporator as used in the normal operating position. Finally, terms of degree such as "substantially", "about" and "approximately" as used herein mean a reasonable amount of deviation of the modified term such that the end result is not significantly changed.

While only selected embodiments have been chosen to illustrate the present invention, it will be apparent to those skilled in the art from this disclosure that various changes and modifications can be made herein without departing from the scope of the invention as defined in the appended claims. For example, the size, shape, location or orientation of the various components can be changed as needed and/or desired. Components that are shown directly connected or contacting each other can have intermediate structures disposed between them. The functions of one element can be performed by two, and vice versa. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such feature(s). Thus, the foregoing descriptions of the embodiments according to the present invention are provided for illustration only, and not for the purpose of limiting the invention as defined by the appended claims and their equivalents.

What is claimed is:

1. A vapor compression system comprising:

a compressor configured and arranged to compress a refrigerant; a condenser configured and arranged to condense the refrigerant that has been compressed by the compressor;

an expansion device configured and arranged to reduce pressure of the refrigerant that has been condensed by the condenser; and an evaporator configured and arranged to evaporate the refrigerant discharged from the expansion device, the evaporator including a shell with a longitudinal center axis extending generally parallel to a horizontal plane, a distributing part disposed inside of the shell, and configured and arranged to distribute the refrigerant, and a tube bundle including a plurality of failing-film-type heat transfer tubes disposed inside of the shell below the distributing part so that the refrigerant discharged from the distributing part is supplied onto the tube bundle to form a liquid film along an exterior wall of each of the falling-film-type heat transfer tubes, all of the falling-film-type heat transfer tubes disposed inside of the shell extending generally parallel to the longitudinal center axis of the shell and arranged in a plurality of columns extending parallel to each other when viewed along the longitudinal center axis of the shell, the tube bundle having an upper region and a lower region, the falling-film-type heat transfer tubes in the tube bundle having both of an arrangement in which a vertical pitch between a first falling-film-type heat transfer tube disposed immediately below the distributing part and a second falling-film-type heat transfer tube disposed immediately below the first falling-film-type heat transfer tube among the falling-film-type heat transfer tubes in at least one of the columns is larger than a vertical pitch between adjacent ones of the falling-film-type heat transfer tubes in the at least one of the columns in the lower region of the tube bundle, and an arrangement in which a horizontal pitch between adjacent ones of the columns is larger in an outer region of the tube bundle than in an inner region of the tube bundle, wherein the horizontal pitch between adjacent ones of the columns gradually increases from the inner region to the outer region of the tube bundle.

2. The vapor compression system according to claim 1, wherein the vertical pitch between adjacent ones of the falling-film-type heat transfer tubes in the at least one of the columns gradually increases from the lower portion to the upper region of the tube bundle.

3. The vapor compression system according to claim 1, wherein the vertical pitch between adjacent ones of the falling-film-type heat transfer tubes in the at least one of the columns arranged in the lower region of the tube bundle is a first vertical pitch, and the vertical pitch between adjacent ones of the falling-film-type heat transfer tubes in the at least one of the columns arranged in the upper region of the tube bundle is a second vertical pitch that is larger than the first vertical pitch.

4. The vapor compression system according to claim 1, wherein the vertical pitch between adjacent ones of the falling-film-type heat transfer tubes in the at least one of the columns arranged in the lower region of the tube bundle is constant, and the vertical pitch between adjacent ones of the falling-film-type heat transfer tubes in the at least one of the columns arranged in the upper region of the tube bundle gradually increases in a direction from the lower portion to the upper region of the tube bundle.

5. The vapor compression system according to claim 1, wherein the vertical pitch between adjacent ones of the falling-film-type heat transfer tubes arranged in each of the columns is larger in the upper region of the tube bundle than in the lower region of the tube bundle.

6. The vapor compression system according to claim 1, wherein a vertical distance between the distributing part and the tube bundle is larger in the outer region of the tube bundle than in the inner region of the tube bundle.

7. The vapor compression system according to claim 6, wherein the vertical distance between the distributing part and the tube bundle gradually increases from the inner region to the outer region of the tube bundle.

8. The vapor compression system according to claim 1, wherein a vertical gap is formed between the upper region and the lower region of the tube bundle with the vertical gap being larger than the vertical pitch between adjacent ones of the falling-film-type heat transfer tubes in the at least one of the columns arranged in the upper region of the tube bundle.

9. The vapor compression system according to claim 8, further comprising an intermediate distributing section disposed in the vertical gap between the upper portion and the lower region of the tube bundle.

10. The vapor compression system according to claim 1, wherein the arrangement in which the horizontal pitch between adjacent ones of the columns is varied so that a flow velocity of the refrigerant vapor flowing between the falling-film-type heat transfer tubes does not exceed a prescribed flow velocity.

11. A vapor compression system, comprising:

a compressor configured and arranged to compress a refrigerant;

a condenser configured and arranged to condense the refrigerant that has been compressed by the compressor;

an expansion device configured and arranged to reduce pressure of the refrigerant that has been condensed by the condenser; and an evaporator configured and arranged to evaporate the refrigerant discharged from the expansion device, the evaporator including a shell with a longitudinal center axis extending generally parallel to a horizontal plane, a distributing part disposed inside of the shell, and configured and arranged to distribute a refrigerant, and a tube bundle including a plurality of heat transfer tubes disposed inside of the shell below the distributing part so that the refrigerant discharged from the distributing part is supplied onto the tube bundle, the heat transfer tubes extending generally parallel to the longitudinal center axis of the shell and arranged in a plurality of columns extending parallel to each other when viewed along the longitudinal center axis of the shell, the tube bundle having an arrangement in which a horizontal pitch between adjacent ones of the columns is larger in an outer region of the tube bundle than in an inner region of the tube bundle, wherein the horizontal pitch between adjacent ones of the columns gradually increases from the inner region to the outer region of the tube bundle.

* * * * *